US007165494B2

(12) United States Patent
Shields

(10) Patent No.: US 7,165,494 B2
(45) Date of Patent: Jan. 23, 2007

(54) SYSTEM AND METHOD FOR DELIVERING AND FLUSHING INK AND OTHER LIQUIDS IN A PRINTING PRESS

(75) Inventor: Gerald N. Shields, Chicago, IL (US)

(73) Assignee: Graymills Corporation, Chicago, IL (US)

( * ) Notice: Subject to any disclaimer, the term of this patent is extended or adjusted under 35 U.S.C. 154(b) by 0 days.

(21) Appl. No.: 10/714,706

(22) Filed: Nov. 17, 2003

(65) Prior Publication Data

US 2004/0123758 A1 Jul. 1, 2004

Related U.S. Application Data

(60) Provisional application No. 60/427,000, filed on Nov. 15, 2002.

(51) Int. Cl.
*B41F 33/00* (2006.01)

(52) U.S. Cl. ..... 101/483; 101/424

(58) Field of Classification Search ..... 101/350, 101/349, 335, 366, 364, 424, 483, 484
See application file for complete search history.

(56) References Cited

U.S. PATENT DOCUMENTS 4,256,100 A * 3/1981 Levy et al. ..... 128/204.21
5,025,954 A * 6/1991 Dunnous ..... 222/56
5,330,576 A * 7/1994 Clauditz ..... 118/688
5,367,982 A * 11/1994 DeMoore et al. ..... 118/46
5,680,960 A * 10/1997 Keyes et al. ..... 222/64
5,683,508 A * 11/1997 Bleiler et al. ..... 118/46
5,816,163 A * 10/1998 Achelpohl et al. ..... 101/483
5,967,044 A * 10/1999 Marschke ..... 101/363
6,019,040 A * 2/2000 Mollers ..... 101/366
6,453,812 B1 * 9/2002 Ikeda et al. ..... 101/365
6,558,554 B1 * 5/2003 Jones et al. ..... 210/739
6,588,399 B1 * 7/2003 Okamoto et al. ..... 123/305
6,776,099 B1 * 8/2004 Landa et al. ..... 101/489
2002/0023561 A1 2/2002 Leimand
2002/0023587 A1 2/2002 Burgard

FOREIGN PATENT DOCUMENTS

| | | |
|---|---|---|
| DE | 19757094 | 6/1999 |
| DE | 19902567 | 8/2000 |
| EP | 0612618 | 8/1994 |
| GB | 2267061 | 11/1993 |
| GB | 2332394 | 6/1999 |

* cited by examiner

*Primary Examiner*—Anthony H. Nguyen
(74) *Attorney, Agent, or Firm*—Marshall, Gerstein & Borun LLP

(57) ABSTRACT

An enclosed Flush/Rinse and inking system for inking and flushing printing presses is arranged to ink an anilox roller of a printing press, wherein the ink is dispersed from a centralized ink tank. Once inking is complete, the ink is returned to the ink tank, and used flushing solution is circulated within the printing circuit to clean the press. A final rinse of clean solution is provided to ensure the press is properly cleaned.

31 Claims, 21 Drawing Sheets

INK PRIMING

INKING

INK FLOW SENSING

INK RETURN

DE-ENERGIZED

FLUID TRANSFER

FLUSH PRIMING

FLUSH

FLUSH RETURN

RINSE PRIMING

RINSE

RINSE HOLD

RINSE RETURN

CLEAN FLUSH FILL

SYSTEM AND METHOD FOR DELIVERING AND FLUSHING INK AND OTHER LIQUIDS IN A PRINTING PRESS

CROSS REFERENCE TO RELATED APPLICATIONS

This application is a non-provisional application claiming priority from U.S. Provisional Application Ser. No. 60/427,000, titled "System and Method for Delivering and Flushing Ink and Other Liquids in a Printing Press," filed Nov. 15, 2002, and incorporated herein by reference.

FIELD OF THE INVENTION

The present invention relates generally to printing press cleaning and, more specifically, to a system and method for delivery and flushing ink and other liquids in an anilox printing press.

BACKGROUND

It is known that the normal operation of a printing press requires inking and cleaning. The proper cleaning of the printing press is critical to efficient operation of the printing press, and effective cleaning is extremely important when it comes to anilox rolls. The amount of ink transferred to the anilox roller is dependent upon the anilox cell volume, and therefore, an anilox roller with plugged cells will deliver reduced amounts of ink, resulting in diminished print quality.

According to one typical cleaning technique, a printing press is stopped and the anilox roll is removed and cleaned by hand. As is known, in some circumstances this technique may result in lost productivity, potential injury to the environment, increased hazard exposure to workers, and oftentimes, inferior cleaning. Some examples of hand cleaning techniques include chemical washes, media blasts, baking soda and cryogenic systems, ultrasonic cleaning, and laser cleaning.

In yet another cleaning technique, the printing press is stopped and the anilox roll may be cleaned by hand while still on the press. Again, by utilizing manual cleaning methods to clean the roll, lost productivity, and potential injury to the environment and to the workers who must enter the hazardous printing may result.

Therefore, it is desirable to provide a system for delivering and flushing ink in a printing press to offer the capability to avoid cleaning the press by hand. In this way, a press operator may possibly avoid potential press downtime as well as exposure to injury to both the environment and workers.

DETAILED DESCRIPTION OF VARIOUS EMBODIMENTS

The embodiments described herein are not intended to be exhaustive or to limit the scope of the invention to the precise form or forms disclosed. Rather, the following exemplary embodiments have been chosen and described in order to best explain the principles of the invention and to enable others or ordinary skill in the art to follow the teachings thereof.

Figure 1:
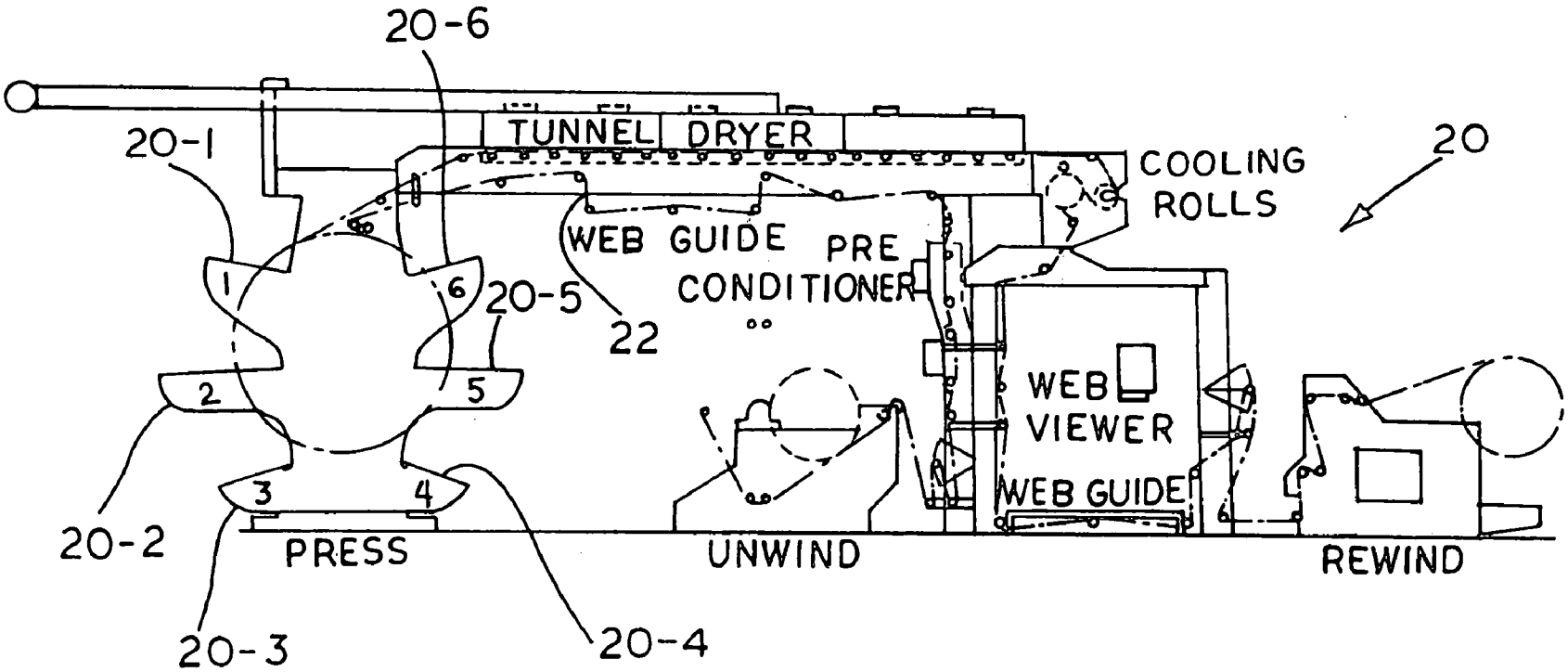
FIG. 1 is an elevational view of a six color flexographic common impression printing press.

Referring now to FIG. 1 of the drawings, a six color flexographic common impression printing press of the type commonly known in the art is referred to by the reference numeral 20. The press 20 typically includes a plurality of printing stations, for example 20-1 through 20-6, for applying ink or an ink solution (hereinafter "ink") to a web 22. As would be known, each of the printing stations 20-1 through 20-6 includes a system for applying ink to an anilox roll, such as an enclosed or open type doctor blade system (see FIGS. 5 and 6), which is discussed in greater detail below.

Each station 20-1 through 20-6, as well as the press 20, may include a plurality of other components, all of which may be conventional and would be known to those of ordinary skill in the art.

Figure 2:
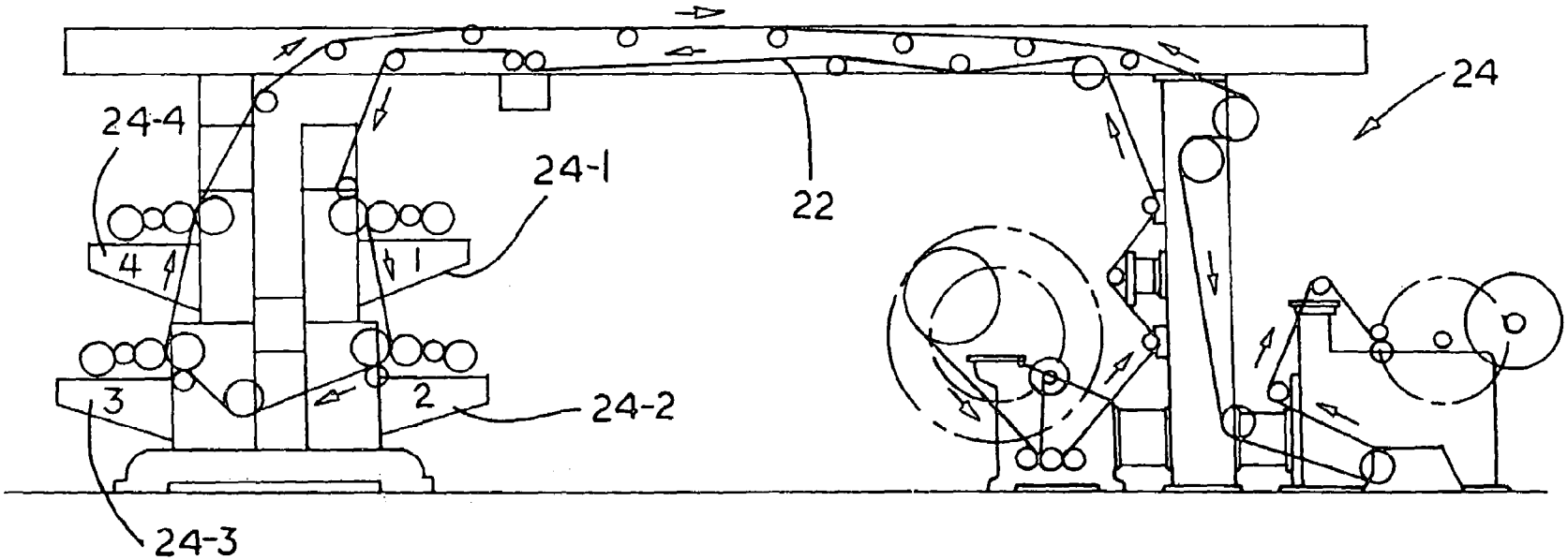
FIG. 2 is an elevational view of a wide web stack type flexographic printing press.

Referring now to FIG. 2 of the drawings, a wide web stack type flexographic printing press of the type commonly known in the art is referred to by the reference numeral 24. The press 24 typically includes a plurality of printing stations, for example 24-1 through 24-4, for applying ink to the web 22. As would be known, each of the printing stations 24-1 through 24-4 includes a system for applying ink to an anilox roll. Again, such a system may comprise an enclosed, open, or other type of doctor blade system. Each station 24-1 through 24-4 as well as the press 24 may include a plurality of other components, all of which may be conventional and would be known to those of ordinary skill in the art.

Figure 3:
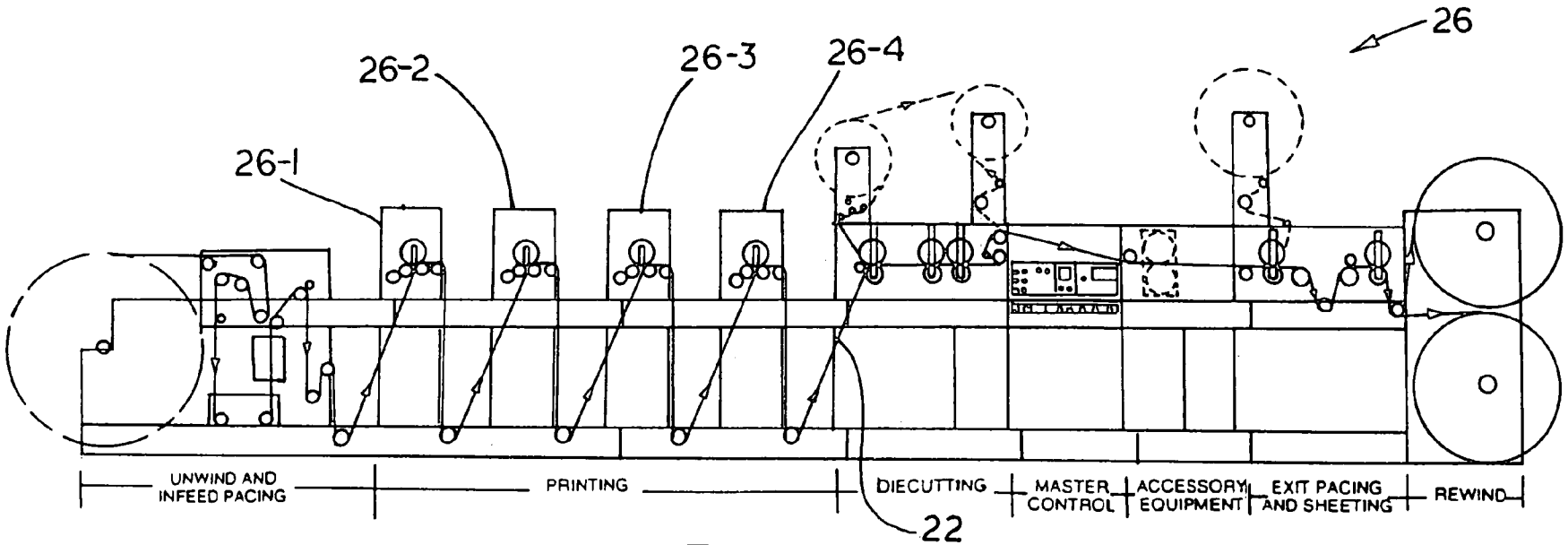
FIG. 3 is an elevational view of a narrow web in-line flexographic printing press.

Referring now to FIG. 3 of the drawings, a narrow web in-line flexographic printing press of the type commonly known in the art is referred to by the reference numeral 26. The press 26 typically includes a plurality of printing stations, for example 26-1 through 26-4, for applying ink to the web 22. As would be known, each of the printing stations 26-1 through 26-4 includes a system for applying ink to an anilox roll. Again, such a system may comprise an enclosed, open, or other type of doctor blade system. Each station 26-1 through 26-4 as well as the press 26 may optionally include a plurality of other components, all of which may be conventional and would be known to those of ordinary skill in the art.

The above-identified presses 20, 24 and 26 are mentioned herein for purposes of illustration only. The use of other types of presses may be contemplated, but for the sake of convenience, the following discussion will refer only to the press 20. It will be understood that the teachings described herein may be equally applicable to each of the aforementioned presses 20, 24, 26, and to any flexographic, gravure, and/or offset lithographic presses. Further, it will be understood that the teachings described herein may be applicable to other systems and/or methods of applying inks, coatings, and/or other materials to a substrate.

Figure 5:
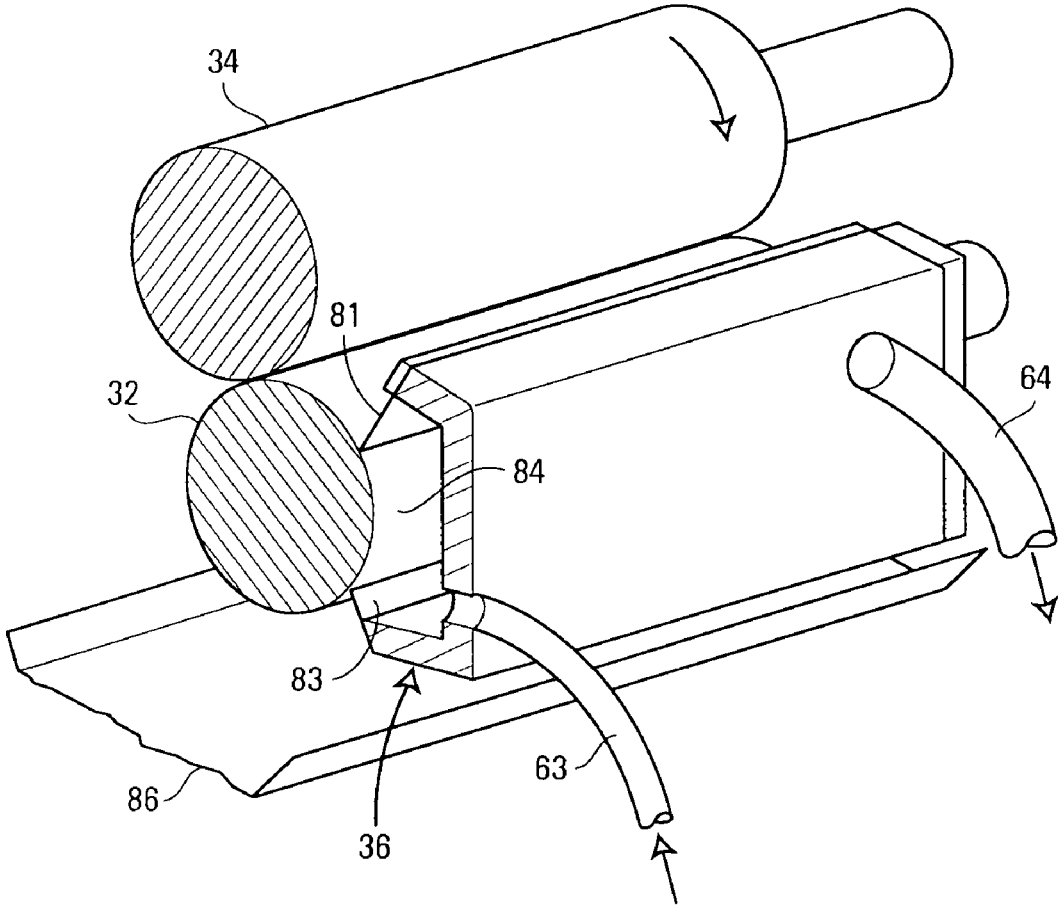
FIG. 5 is an enlarged fragmentary view in perspective of an enclosed doctor blade/anilox roll system for applying ink to an anilox roll.
Figure 6:
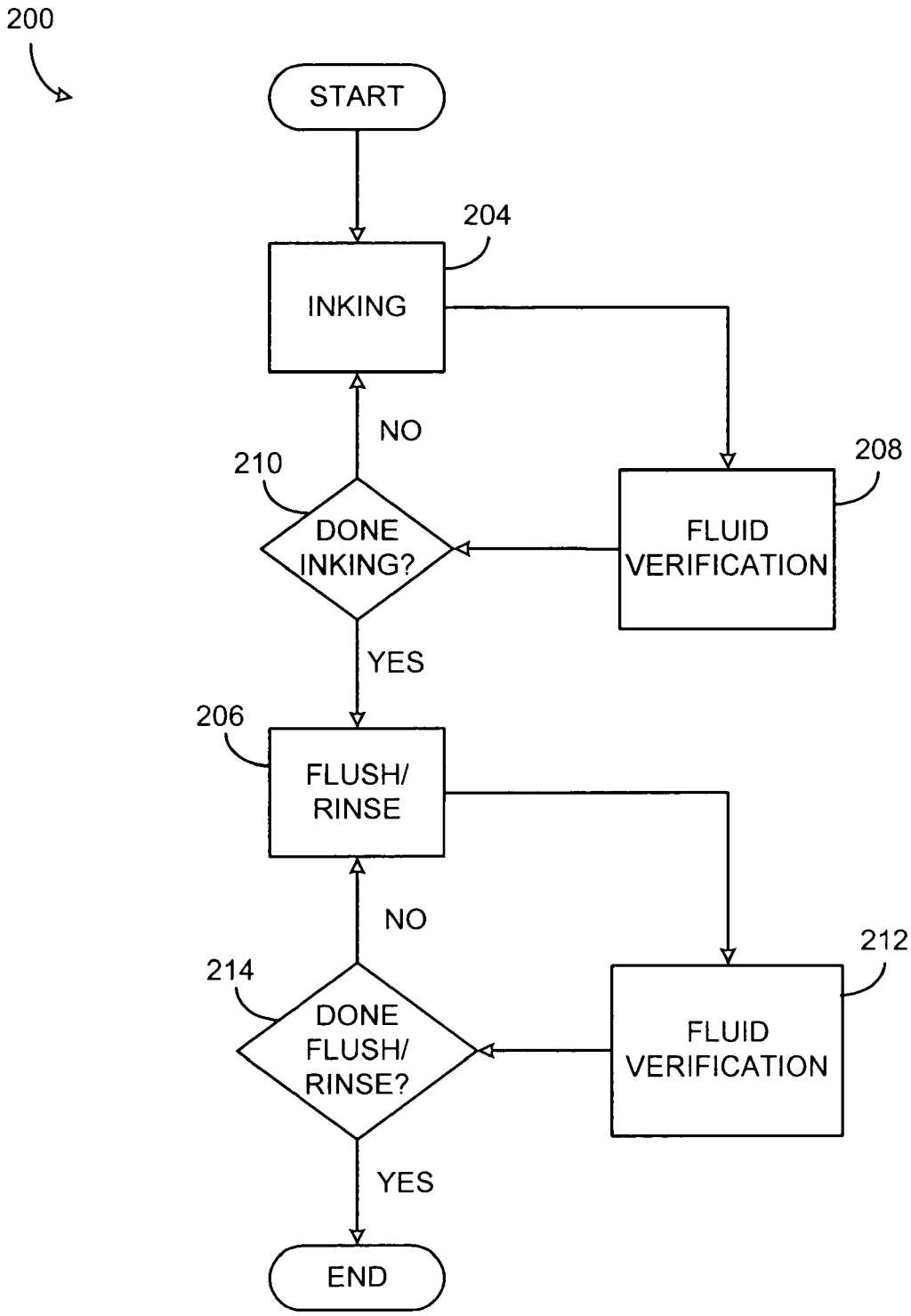
FIG. 6 is a flowchart of an embodiment of a main routine that may be performed during operation of the flexographic ink/flush system of FIG. 4.

Referring now to FIGS. 5, and 6, a flexographic ink/flush system 28 is illustrated, which may be used to apply an ink 30, a clean rinse 31, and a used flush 33 to an anilox roll 32 on the press 20, for subsequent application to a plate cylinder 34. As mentioned above, the ink/flush system 28 may be equally applicable to any one of the presses 20, 24, 26 mentioned above. The illustrated embodiment includes a power supply 35, a chamber doctor blade system 36, an ink station 38, a flush station 40, and a control station 42. The control station 42 may further include a controller 41, a display 43, a power converter 45, and light tower 90, all operatively connected as is known in the art. A plurality of lines 46, 48 and 50 are provided to operatively couple the various station components. For example, the lines 46, 48, and 50 may operatively couple the control station 42 with the flush station 40 and the ink station 38.

The control station 42 and the controllers 49, 51 may be operatively coupled by, for example, a ControlNet™ or other type of Programmable Logic Controller (PLC) communication protocol network with each station being set up as a node or station on the PLC communication protocol network. Each station 38, 40, 42 may be operatively coupled with all control signals traversing over lines 46, 48, and 50, which may be a single fiber optic type RG6 cable or other type of communication cabling from and within the control station to each of the remote ink station(s) and flush station. It will be appreciated that the arrangement of the stations can vary based on design requirements. Furthermore, it will be understood that preferably, their sequence within the system may be changeable without any need to change any coding. Moreover, as depicted in FIG. 5, the control station 42 may be designed to reside outside of a hazardous Class 1, Division 1 environment, while all other stations 38, 40 are suitable for installation in the hazardous area.

The power supply 35, which may be, for example, a single 120V/1 phase power outlet is typically provided for powering the control station 42. The power output may be converted from 120V AC to 24V DC in the control station 42 by the power converter 45 and subsequently routed through intrinsically safe devices that send and receive the necessary signals to operate and control the system.

In one embodiment, each station 38, 40 may additionally be supplied with an air supply (not shown) such as, for example, a 100-psi, oil-free air supply. The air supply may utilize an air filter such as, for example, a 5 micron filter with coalescing filter. The flush station 40 may use up to 10 cubic feet per minute at standard conditions (SCFM), while each ink station 38 typically may use up to 15 SCFM.

The ink/flush system 28 further includes an ink pump 58, and a flush pump 59. The pumps 58, 59 and the doctor blade system 36 are fluidly connected by a plurality of fluid lines 60, 61, 62, 64, 66, 68, 70, 72, 74, 76, 78, 80, 82 and associated valves V1, V2, V3, V4, V5, V6, V7, V8, V9, V10, V11, V12, V13, V14, V15, V16. The ink/flush system 28 may also include a filter and/or surge protector 52, as well as at least one flow sensor 54. It will be appreciated that the configuration of the fluid lines, associated valves, filters, and sensors may be varied according to known design parameters, as well as application requirements. Furthermore, It will be appreciated that the system 28 will typically include pumps, valves, sensors, solenoids, PLC controllers, Human Machine Interface (HMI) devices, etc., and other conventional components (not shown) as would be known by one of ordinary skill in the art. It will be understood that the aforementioned components may also be applied to a system for applying coatings to a web or other substrate in order to supply ink and flush the system in a similar manner.

A plurality of control switches 100, 102, 104, 106, 108, 110, 112, all operatively connected in a known manner, may be provided to control operation of the ink/flush system 28. By way of illustration only, the control switch 100 may be the main power supply switch, the switches 102, 106 may be emergency stop switches, while the remaining switches 104, 108, 110 may control other operational functions. Any number of switches may be provided within the ink/flush system 28 as is known in the art.

Referring now to FIG. 6, the doctor blade system 36 is a closed chamber doctor blade system and includes a pair of doctor blades 80, 82 and a drip pan 81. Alternatively, the doctor blade system 36 may be an open type chamber doctor blade system and may include a single blade (not shown). The doctor blade system 36 also includes a chamber 84 which may operatively contain a quantity of either the ink 30, the clean rinse 31, or the used flush 33, supplied to the doctor blade system 36 via the line 72, and are returned through the line 74 to either the appropriate location.

Figure 4:
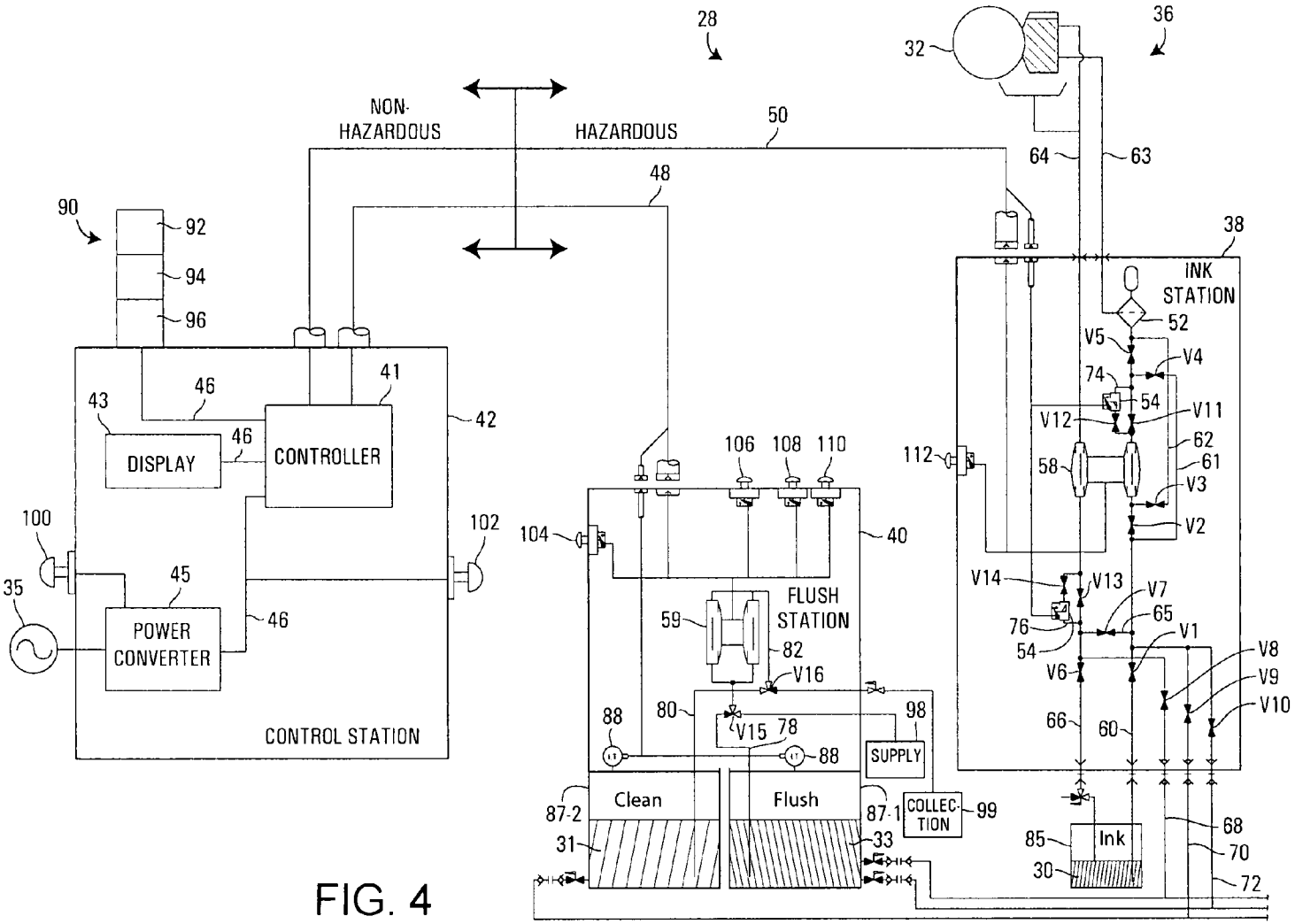
FIG. 4 is a schematic illustration of an exemplary embodiment of a flexographic ink/flush system for supplying ink and Flush/Rinse solution to the chamber doctor blade/anilox roll system on a printing press.

In the illustrated embodiment of FIG. 4, the inking station 38 comprises pumping and control capabilities to service a single deck. For instance, the station 38 may comprise an ink tank 85, or other suitable fluid retainer, adapted to contain the ink 30 and the ink pump 58 which may be an air-driven double-diaphragm pump. At the outlet of the ink pump 58 there may be the surge-suppressing filter 52. During circulation, one side of the pump 56 may pump fluid (e.g., ink or flush) to the doctor blade system 36 via line 72 while the other may pull an equal volume of fluid from the doctor blade system 36 via lines 60, 63. In this way, the ink/flush system 28 may be protected from over pressurization. During draining of the circuit, described below, both sides of the pump 58 may effectively pull fluid back from the doctor blade system 36 via both lines 63 and 64. The pump 58 and the associated valving may also be used during the Flush/Rinse process described below. Moreover, during some stages of the Flush/Rinse process the valves and pump may be used to isolate the single deck and to circulate cleaning fluid within that deck's fluid circuit. Additionally, the flow sensors 54 may be adapted to act like a flow sensor and may be used to signal full/empty, flow/no-flow, and/or other similar conditions that may trigger process step changes or alarm conditions.

Furthermore, in the disclosed embodiment, the flush station 40 has two tanks, one tank 87-1 adapted to contain the used flush 33 and another tank 87-2 for the clean rinse 31. The flush station 40 supplies and recalls the used flush 33 and the clean rinse 31 for each inking station 38. Each tank 87-1, 87-2 may be supplied with a level transmitter 88 which may sense the level of the fluid within the respective tank and take appropriate actions (i.e., recharge or discharge) to keep the fluid level within operational levels. To recharge the tanks, a fresh supply of clean rinse 31 may be maintained in a supply tank 89-1. The fresh supply of clean flush may then be used to recharge the tanks 87-1, 87-2 as necessary. The ink/flush system 28 is also capable of discharging the used or clean flush, either locally and/or to a remote location such as, for example a discharge tank 89-2. Like the inking station 38, the flush station 40 typically has at least one pump 59, which may be an air-driven double diaphragm pump.

The ink station 38 may be supplied as a mobile station which may be disconnected and moved with minimal effort, downtime, and spillage. Moreover, in both the flush station 40 and the inking station 38, intrinsically safe (IS) control signals may be used to power solenoid valves which drive the air-operated valves that control the flow paths for the ink 30, the clean rinse 31, and the used flush 33.

The control station 42 may additionally be supplied with the optional capability of "sensing" whether or not the stations 38, 40 are present at the end of the associated lines 48, 50. By addition of a sensor to each of the stations 38, 40, the control station 42 may determine when each of the stations 38, 40 is connected to the ink/flush system 28. If the control station 42 determines that at least one of the stations 38, 40 is connected to the ink/flush system 28, the associated HMI controls on the control station 42 may be enabled and readied to accept operator inputs to control the various function of the ink station as outlined below. If a station 38, 40 is not connected to the control station 42, the control station 42 may deactivate the associated HMI controls. In this manner, an operator may be prohibited from unintentionally attempting to operate the missing station 38, 40. By sensing the presence of the station 38, 40, the ink/flush system 28 allows for "floating" stations. These floating stations may be moved from press to press in order to maximize press change-over efficiency, or if a press is going to be taken off-line for maintenance, then the stations 38, 40 may be disconnected from their respective lines and moved to other presses for use there.

System Operation

One manner in which the ink/flush system 28 may operate is described below in connection with a flowchart and illustrations which represent a number of portions or routines of one or more steps which may control the operation of the ink/flush system 28. FIG. 6 is a flowchart of a main operating routine 200 that may be stored in the control station 42. Referring to FIG. 6, the main routine 200 may have two basic modes of operation including an inking cycle (block 204) and a Flush/Rinse cycle (block 206). The main routine 200 may begin operation at block 204 during which the inking cycle is initiated. During the inking cycle, the printing press 20 may utilize the press to transfer ink to the desired substrate as is known in the art.

During the inking cycle, the ink/flush system 28 may monitor the fluid characteristics by utilizing the level transmitters 88 and/or the flow sensors 54 (block 208). When the routine 200 detects a parameter which may indicate that the press is operating beyond known acceptable press parameters, a warning or alarm may be issued. For example, the control station 42 may include a light tower 90 with three lights 92, 94, 96 (green, amber, and red) and an alarm horn (not shown). The green light 92 may energized when the unit is operating normally. When a warning needs to be issued, the amber light 94 may be lit and/or the appropriate message may be provided on the control station 42, for example the HMI (Human Machine Interface, i.e. PLC screen displayed on display 43). The warning will be cleared when the operator acknowledges the message. Finally, when an alarm occurs the red light 96 may be lit, the horn may sound, and/or a message may be displayed. In the illustrated embodiment, the horn will be silenced when the operator acknowledges the message but the alarm message will not be cleared until the condition(s) that caused the alarm are corrected.

Fluid levels in the used flush 33 and clean rinse 31 tanks 87-1, 87-2, are monitored during all modes of operation. If at any time the levels get too high, the operator will be warned. If the level continues to rise, prior to fluid overflowing the tanks, the pumps involved in the Flush/Rinse cycle will be shutdown and an alarm will be sounded. On the low side, the controls prevent the pump from running dry. Similarly, an operator may have the ability to pause and/or cancel each cycle at any time.

It will be understood that the system cycles, and system operation checks, may occur any number of times and in any order, depending upon specific operating requirements, and may be determined on a case by case basis. Furthermore, each condition may be triggered by any number of incidents, including programming conditions (e.g., set time conditions), physical conditions, (e.g., a broken connector), or by manually actuated (e.g., pause or stop button depressed).

The routine 200 may then determine whether the inking cycle is complete (block 210). If the inking cycle is complete, the routine may then begin the Flush/Rinse cycle (block 206). Again, during the Flush/Rinse cycle, the routine 200 may monitor the fluid characteristics (block 212) and may initiate a fluid recharge and/or discharge as required. The routine 200 may then determine whether the Flush/Rinse cycle is complete (block 214) and once complete, the routine 200 may be terminated.

Inking

Figure 7:
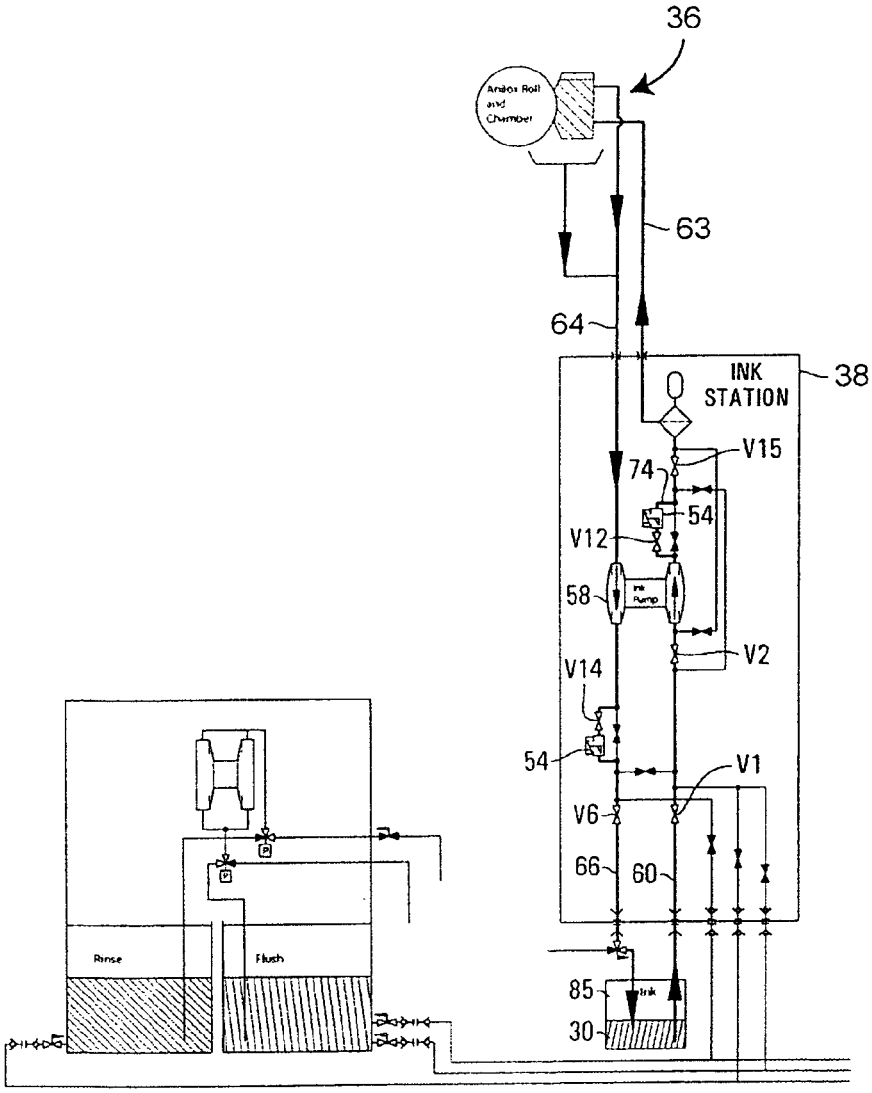
FIG. 7 is a schematic illustration of an exemplary Ink Priming process of the flexographic ink/flush system of FIG. 4.

FIGS. 7–10 are an exemplary schematic illustration of the different steps that may be performed during the Inking cycle shown in FIG. 6. Turning to FIG. 7, there is illustrated an Ink Priming process. As illustrated, during the Ink Priming process, the pump 56 will proceed through a multi-step priming sequence based upon the values entered in the control panel 42 and the recipe speed selected, as is known in the art. The Ink Priming process is intended to prevent chamber over pressurization, over filling, and possible seal leakage. For example, during priming, the pump 58 may be started, and the appropriate valves V1, V2, V12, V5, V14, and V6 may be opened to allow the circulation of the ink 30. In this way, the ink circuit of lines 60, 74, 63, 64, 76, and 66 may be filled with ink 30 and readied for the inking process.

Figure 8:
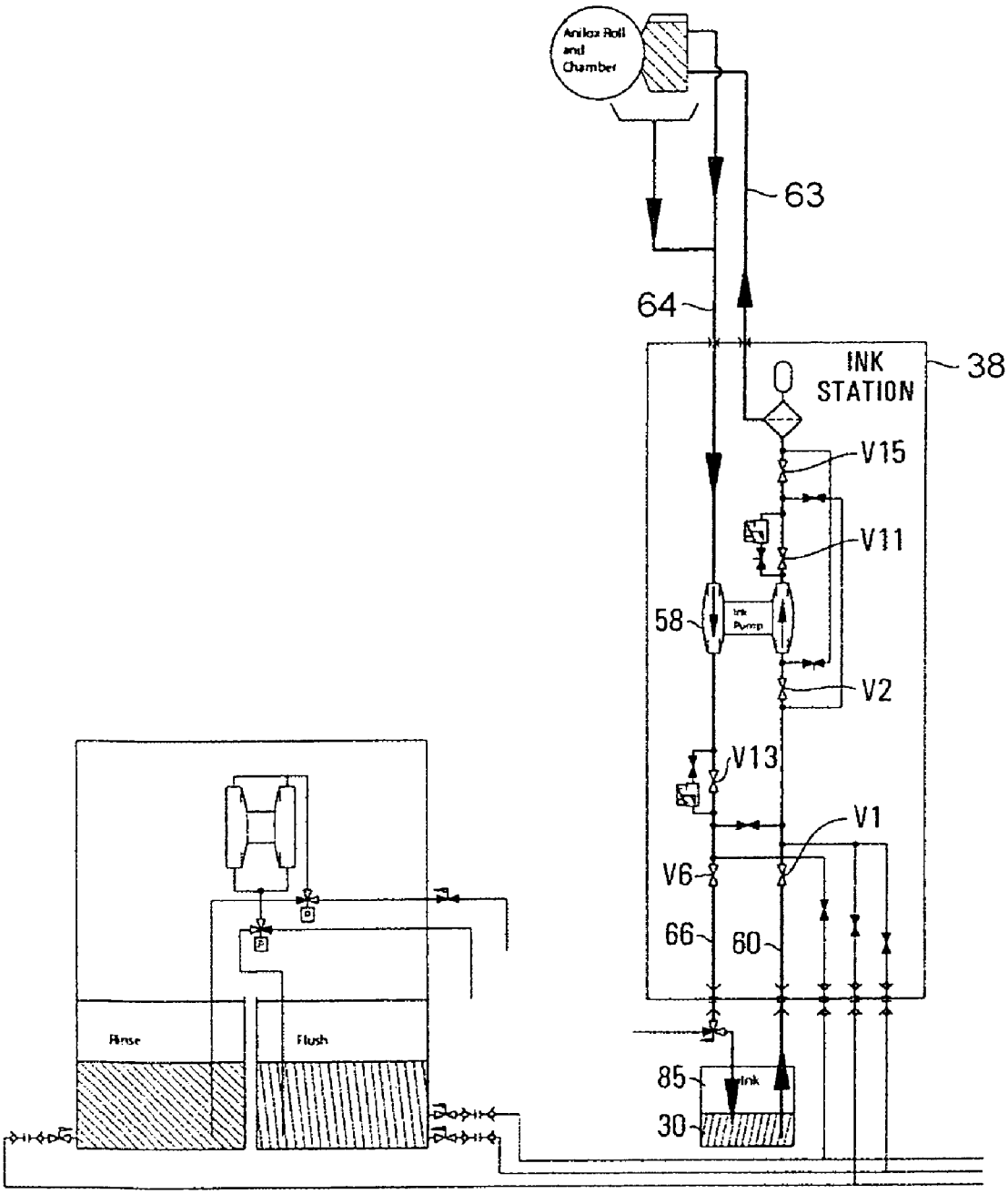
FIG. 8 is a schematic illustration of an exemplary Inking process of the flexographic ink/flush system of FIG. 4.
Figure 9:
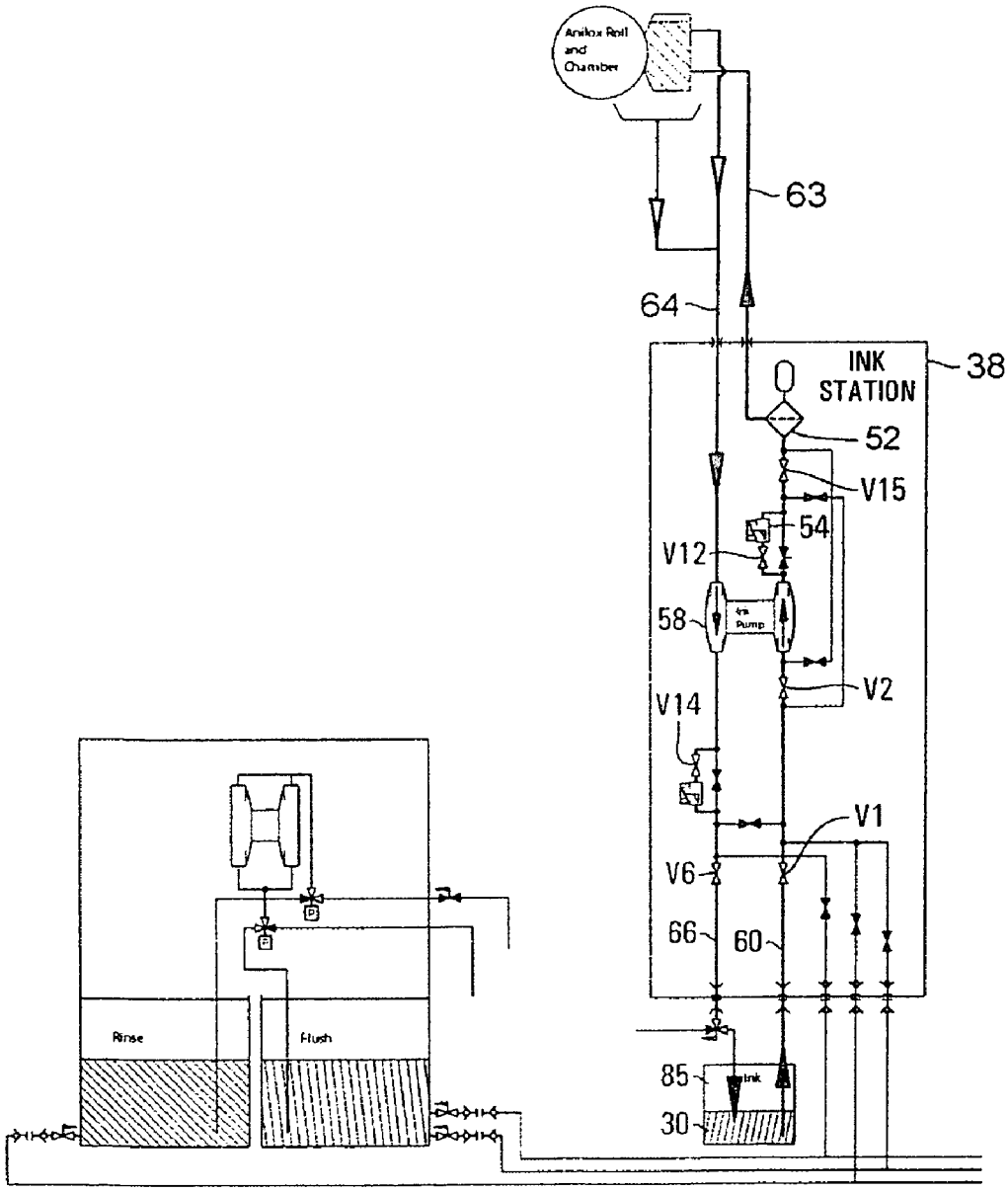
FIG. 9 is a schematic illustration of an exemplary Ink Flow Sensing process of the flexographic ink/flush system of FIG. 4.
Figure 10:
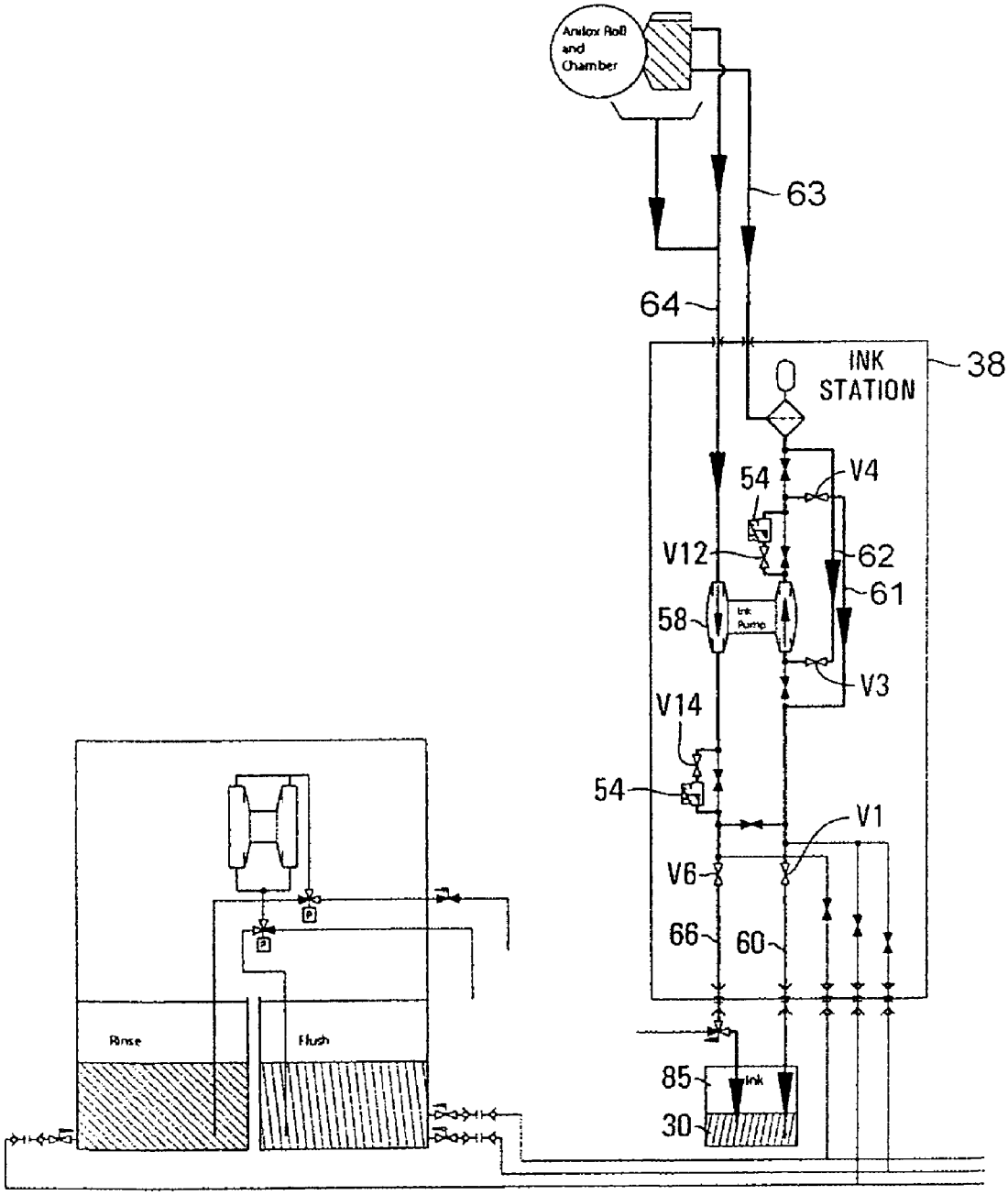
FIG. 10 is a schematic illustration of an exemplary Ink Return process of the flexographic ink/flush system of FIG. 4.

Turning now to FIGS. 8 and 9, the Inking process and Ink Flow sensing process, are illustrated. During the Inking process 302 (FIG. 8), the valves V14 and V12 may be closed, and the valves V13 and V11 may be opened to bypass the sensors 54. By reversing the valve process, the sensors 54 may be utilized during the Inking Flow Sensing process 304 to monitor the ink flow through the system 28. Once the Inking process 302 is started, the ink flow may remain constant or, for larger presses, may ramp up and down with the speed of the press 20. In general, even when the press 20 is stopped the pumps should be in an idle mode to keep the ink mixed, to prevent a skin from forming on the ink in the pail, and to keep the viscosity within range. The pumping speed will generally have a minimum, a maximum, and may or may not ramp between the two while following the press.

The Inking process 302 includes both the positive supply and positive return of ink. The ink 30 is drawn from the ink tank 85, pumped through the pulse-dampening filter 52 and on to the chamber 84 of the press. One side of the air-driven double-diaphragm pump 58 is supplying ink 30 while the other is drawing it back to the ink tank 85. By definition, the same volume is supplied as is returned so that excess pressure should not build within the inking chamber 84.

During the inking process 302, the operator will be able to choose between two operating modes for the pump speed. The speed can be set manually (as a flowrate in gpm) at the control station 42 or the speed can be set to automatically follow a 4–20 mA control signal from the press. This signal is typically proportional to press speed. If the automatic option is selected, the operator is asked to supply an idle speed and a max speed (both in gpm). Between approximately 15% and 80% of the signal from the press the pump speed will ramp linearly or according to any of several pre-defined curves from the idle to the max speed. It will be understood that the ink return pumping rate may be set higher than the ink supply rates to minimize the potential for chamber seals leaking and to avoid over pressurizing the chamber 84.

To start the Inking process the operator initiates the start command from the display 43 of the control station 42 utilizing, for example, an HMI screen. Once the Inking process is initiated, the valves are automatically set to pull ink 30 from the ink tank 85, pump the ink 30 to the chamber 84 and return the ink 30 to the ink tank 85. At any time during the Inking process, the operator may optionally be able to pause the pump 58 which will stop the pump 58 for the selected deck until the operator releases it to continue. Valves assigned to that deck will not change positions during the pause.

When the signal (operator input) is given to end the Inking process, the valves change position and the ink 30 is drawn from the fluid circuit. Specifically, turning to FIG. 10, an Ink Return process, is illustrated. During the Ink Return process 306, the valves V2, and V5 may be closed, and the valves V3 and V4 may be opened to allow the pump 58 to return ink 30 to the ink tank 85 via lines 60, 61, 62, 63, 64, and 66 as shown. The pump 58 may then run at a different, recipe-assigned speed (usually at an increased speed) to pull the ink 30 back from the chamber 84 into the ink tank 85. Flow sensors 54 may be utilized to determine when the ink 30 has been removed from the system 28. Once the ink 30 is returned to the ink tank 85, the system 28 is now ready for the start of the Flush/Rinse cycle. Moreover, the ink tank 85 is now isolated and may be removed for cleaning and refilling if desired.

Flush/Rinse

In general, the Flush/Rinse cycle is recipe driven with a plurality of steps. The Flush/Rinse recipes may be pre-programmed so that during the Flush/Rinse process the operator is free to attend to other press activities. The duration of some of the processes of the Flush/Rinse cycle are established by a time in seconds input by the operator. Others are terminated automatically upon completion of a task such as filling of the circuit. The Ink/Flush system 28 may allow any combination of ink stations 38 to be flushed.

The pump 59 may be used to discharge used flush 33 from the used flush tank 87-1 to another container or to a remote location. In one embodiment, three headers are utilized. One is dedicated to the supply of used flush 33, one to the supply of clean rinse 31, and the last to the return of either solution to the used flush tank. In the illustrated embodiment of FIGS. 4 and 5, two headers are used, wherein one header is shared by both the supply of used flush 33 and clean rinse 31.

The pump 56 is used to drive the used flush 33 and clean rinse 31 solutions through each inking circuit. During the Flush/Rinse cycle, the used flush 33 is taken from and returned to one of the various headers (rather than to or from the ink pail). Valves are cycled to select the supply and discharge locations for each stage of the Flush/Rinse cycle. As with the Inking cycle, both sides of the ink pump 58 can be used to pull the used flush 33 and clean rinse 31 solutions back out of the inking circuit.

Turning now to FIGS. 11–21, exemplary schematic illustrations of the different steps that may be performed during the Flush/Rinse cycle are shown. The steps for the Flush/Rinse Process are illustrated and may be as follows:

0. Off
1. Fluid Transfer
2. Flush Priming
3. Flush Process
4. Flush Return
5. Used Flush Discharge
6. Rinse Priming
7. Rinse
8. Rinse Hold
9. Rinse Return
10. Clean Flush Fill each of which are described below.

Off

Figure 11:
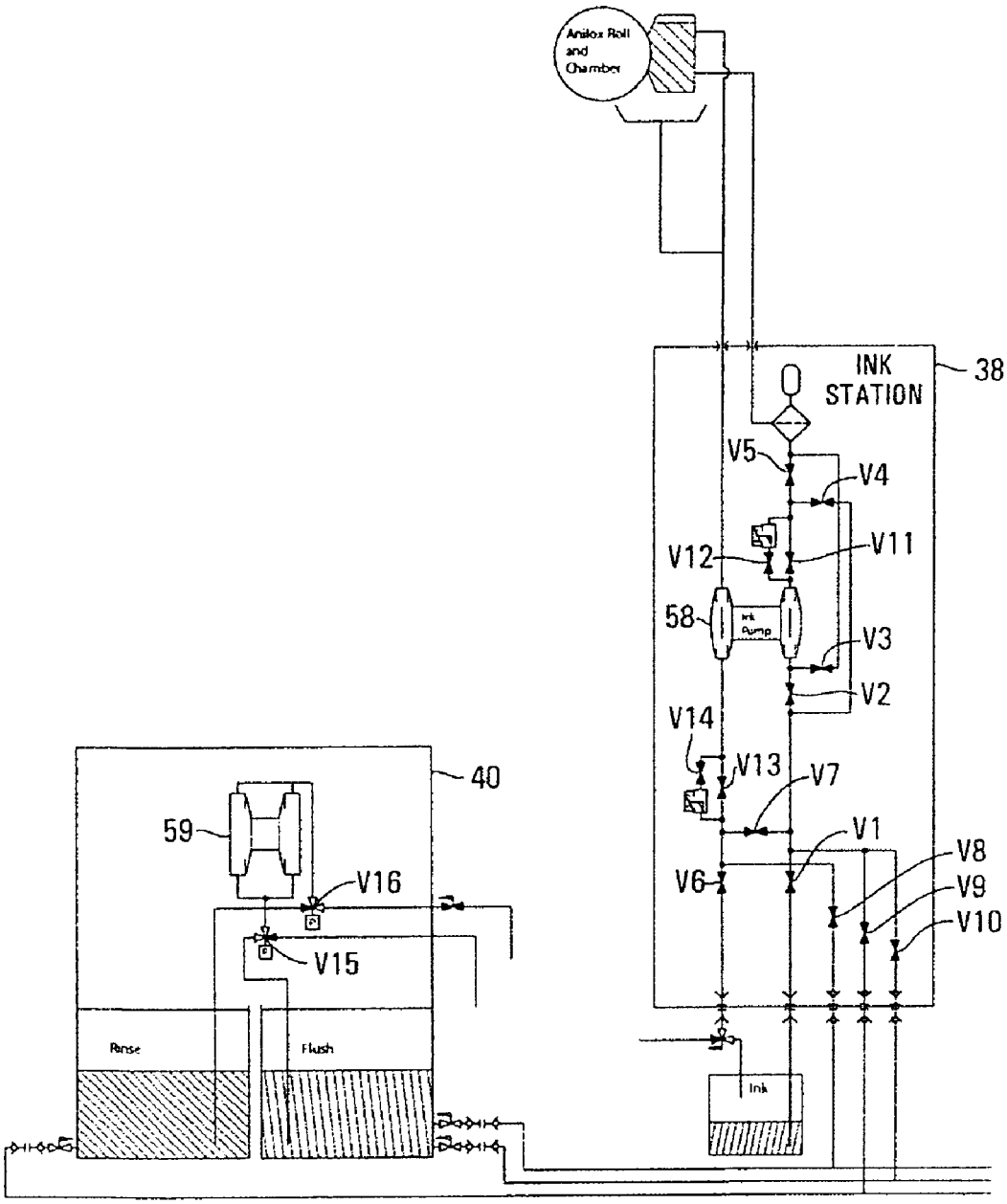
FIG. 11 is a schematic illustration of the flexographic ink/flush system of FIG. 4 in the de-energized state.

When it is desired to complete the Inking cycle, the operator may initiate completion by activating an "End" or "End Inking" button. The "off" process is illustrated in FIG. 11. As shown, the pump 58 and valves V1 through V16 will go to their de-energized state. The system 28 will then be ready for the Flush/Rinse cycle. During the "off" process, the ink tank 85 may be removed for cleaning or ink addition and a Flush/Rinse recipe may then be selected so that the operator can start the Flush/Rinse cycle. It will be appreciated that in the disclosed embodiment, the de-energized state may be biased to a close position (depicted as a solid valve) while the energized state may be an open position (depicted as a non-solid valve).

Fluid Transfer

Typically, the Flush/Rinse cycle will begin with a priming process described below. The first step of the Flush/Rinse cycle, the Fluid Transfer process, is carried out only if needed. Generally, after the first Flush/Rinse cycle, the used flush tank 87-1 will contain a sufficient volume of used flush 33 to permit flushing of the fluid circuits. However, as described above, the levels of both the clean rinse tank 87-2 and the used flush tank 87-1 are continually monitored and when the Flush/Rinse cycle is initiated the control station 42 uses the various recipe and system settings to calculate how much used flush 33 is needed. If the available used flush 33 is insufficient to support the cleaning of the number of decks selected, the control station 42 will automatically start the fluid transfer step. Otherwise, the control station 42 will begin the flush priming step.

Figure 12:
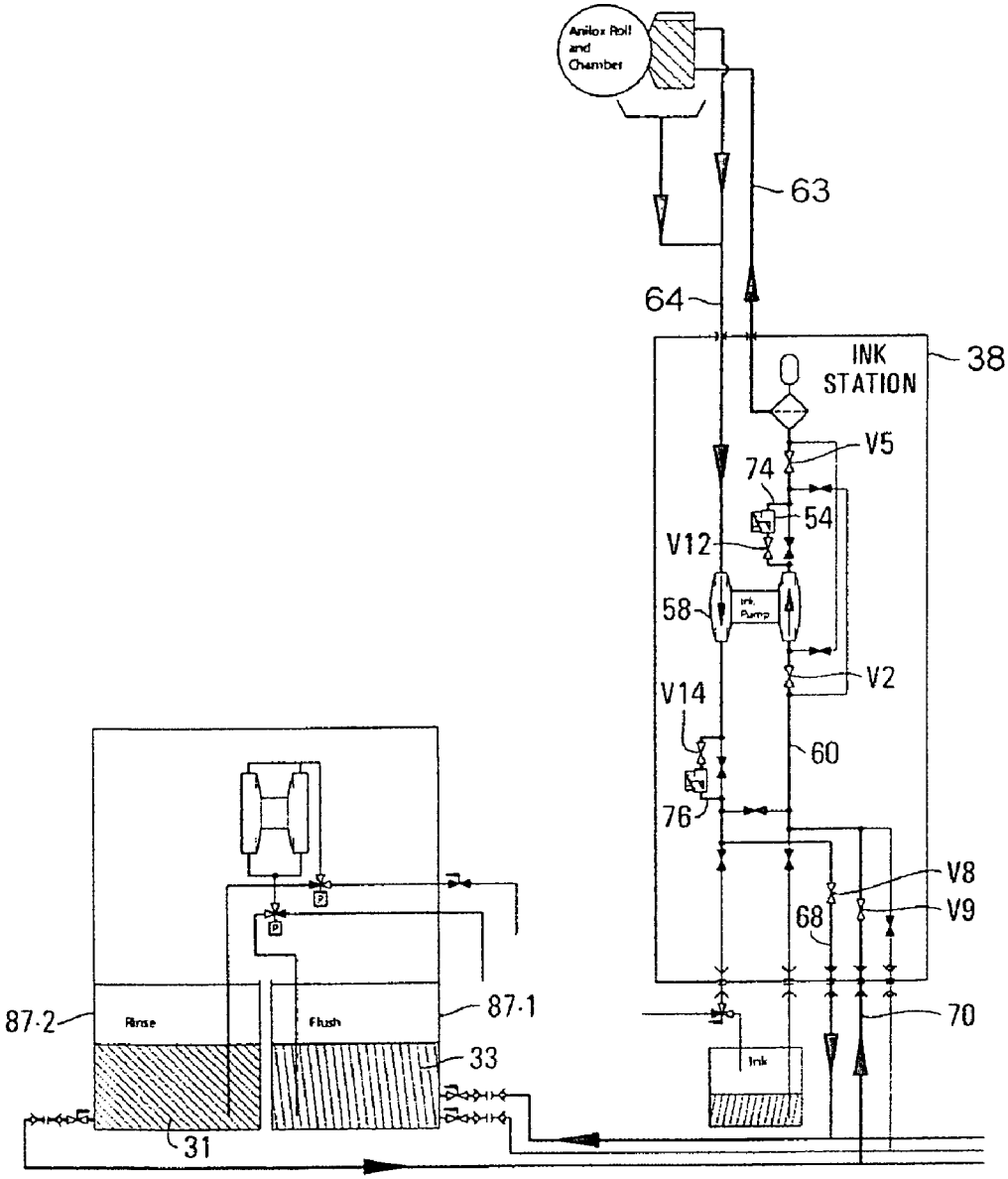
FIG. 12 is a schematic illustration of an exemplary Fluid Transfer process of the flexographic ink/flush system of FIG. 4.

As shown in FIG. 12, when the control station 42 determines that used flush 33 is needed, the system valves V9, V2, V12, V5, V14 and V8, will automatically cycle open to draw clean rinse 31 from the clean rinse tank 87-2. The clean rinse 31 will be pumped through the fluid circuits (lines 70, 60, 74, 63, 64, 76, and 68) by the ink pump 58, and returned to the used flush tank 87-1 through the return header to bring the used flush 33 level in the used flush tank 87-1 to the required level as determined by the controller 41 and the system parameters. When the inking circuits are full, the level of used flush 33 will begin to rise in the used flush tank 87-1. When the level reaches the minimum required level the control station 42 will automatically switch to the Flush Priming process to complete the priming of the circuits. The Fluid Transfer process will also begin to flush out the residual ink, minimizing the volume of used flush 33 used in the Flush/Rinse cycle.

Flush Priming

Figure 13:
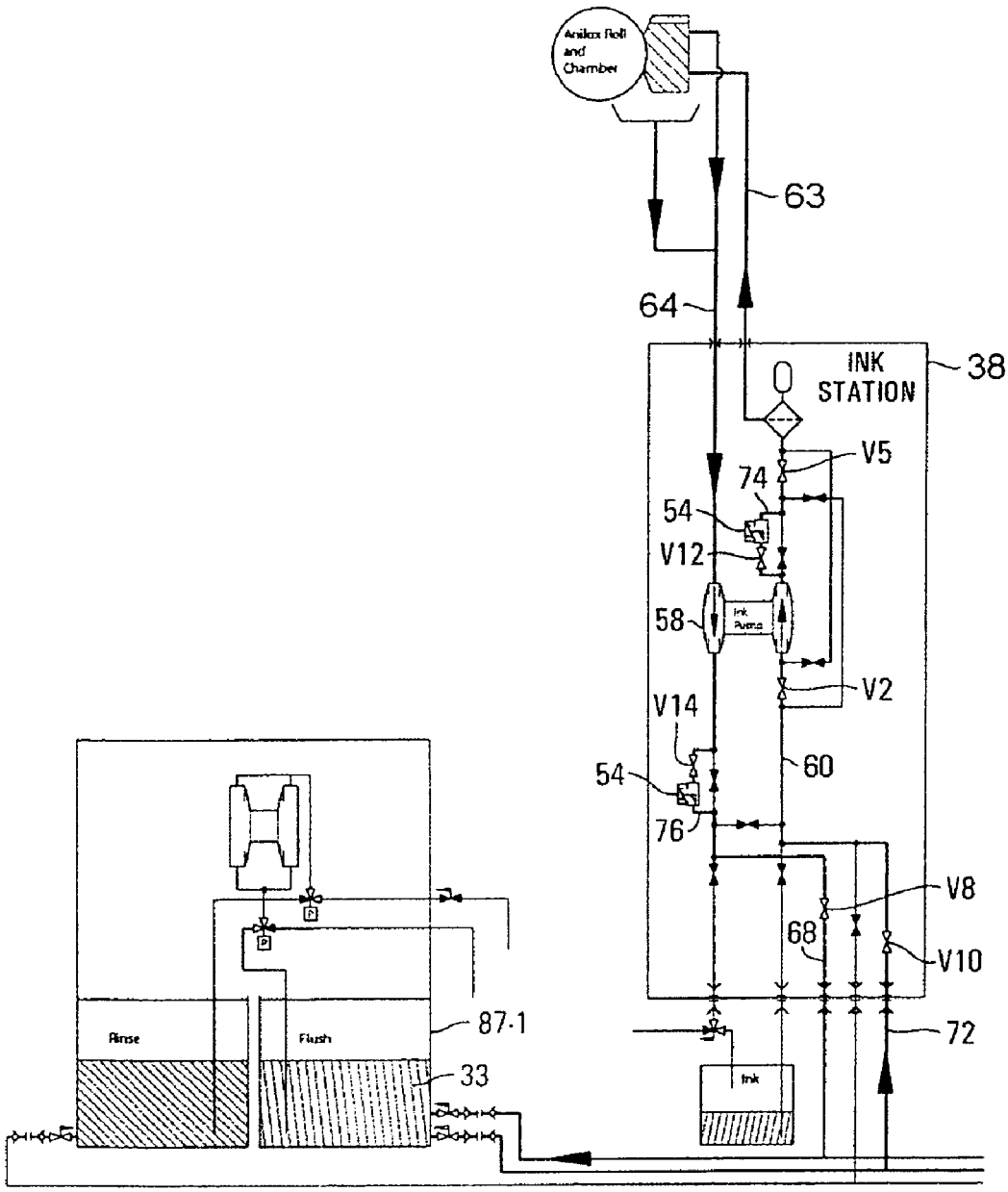
FIG. 13 is a schematic illustration of an exemplary Flush Priming process of the flexographic ink/flush system of FIG. 4.

Turning to FIG. 13, the system valve V9 will close, and the valves V10, V2, V12, V5, V14 and V8, will open to draw used flush 33 from the used flush tank 87-1. The used flush 33 will therefore be pumped through the fluid circuits (lines 72, 60, 74, 63, 64, 76, and 68) by the ink pump 58 through a multi-step priming sequence. The priming sequence is based upon values entered in the PLC and the recipe speed selected. The Flush Priming process is designed to reduce chamber over pressurization, over filling and seal leakage.

Flush

Figure 14:
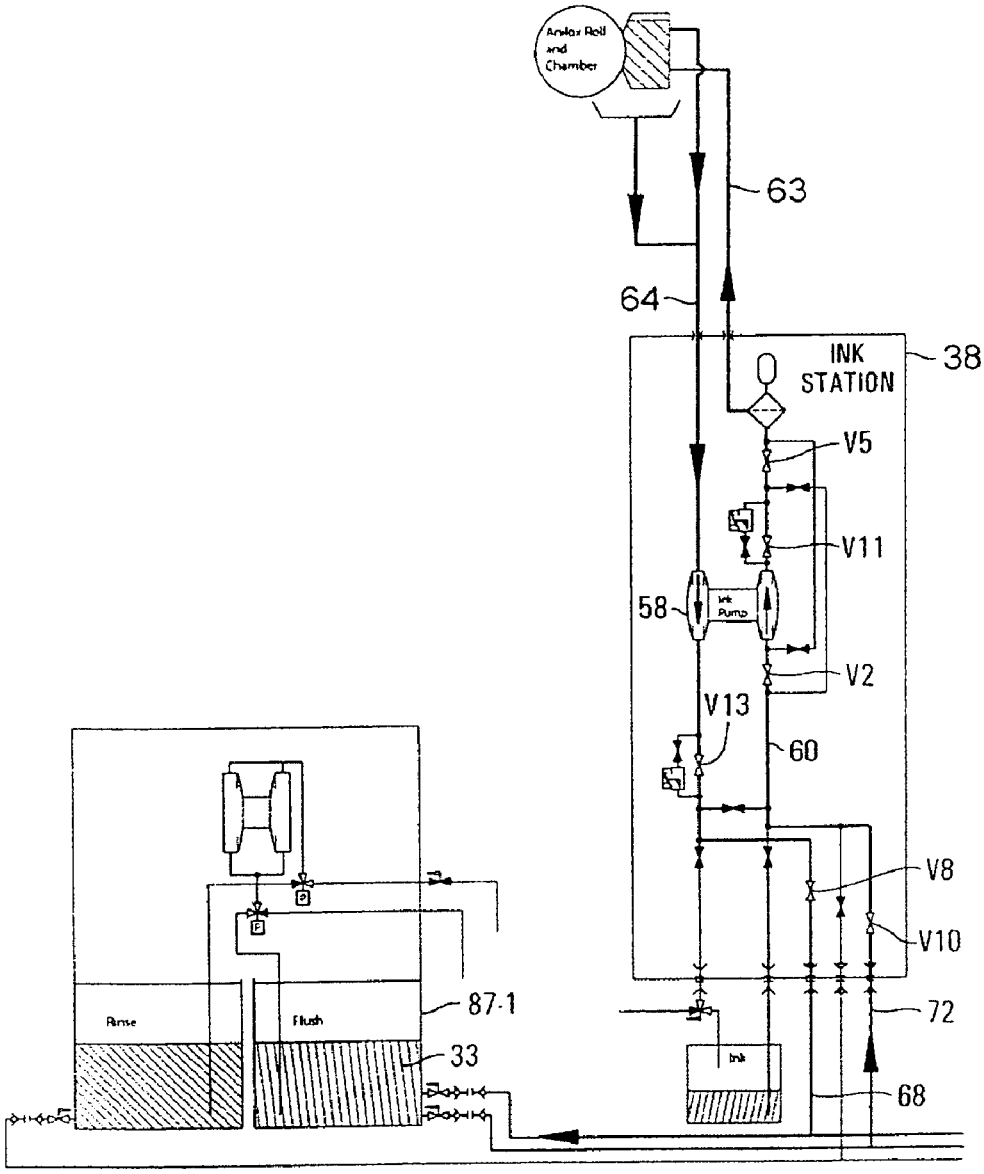
FIG. 14 is a schematic illustration of an exemplary Flush process of the flexographic ink/flush system of FIG. 4.

During the Flush process, as illustrated in FIG. 14, valves V10, V2, V11, V5, V13 and V8 are opened, the used flush 33 is drawn from the used flush tank 87-1, circulated through the inking circuits (lines 72, 60, 74, 63, 64, 76, and 68) to clean the circuit and the inking components, and returned to the used flush tank 87-1 in order to be used in subsequent Flush processes. The ink pump 58 are utilized during the Flush process to circulate the used flush 33. The duration of the Flush process is set in the recipe chosen by the operator during the Flush/Rinse cycle set-up.

Flush Return

Figure 15:
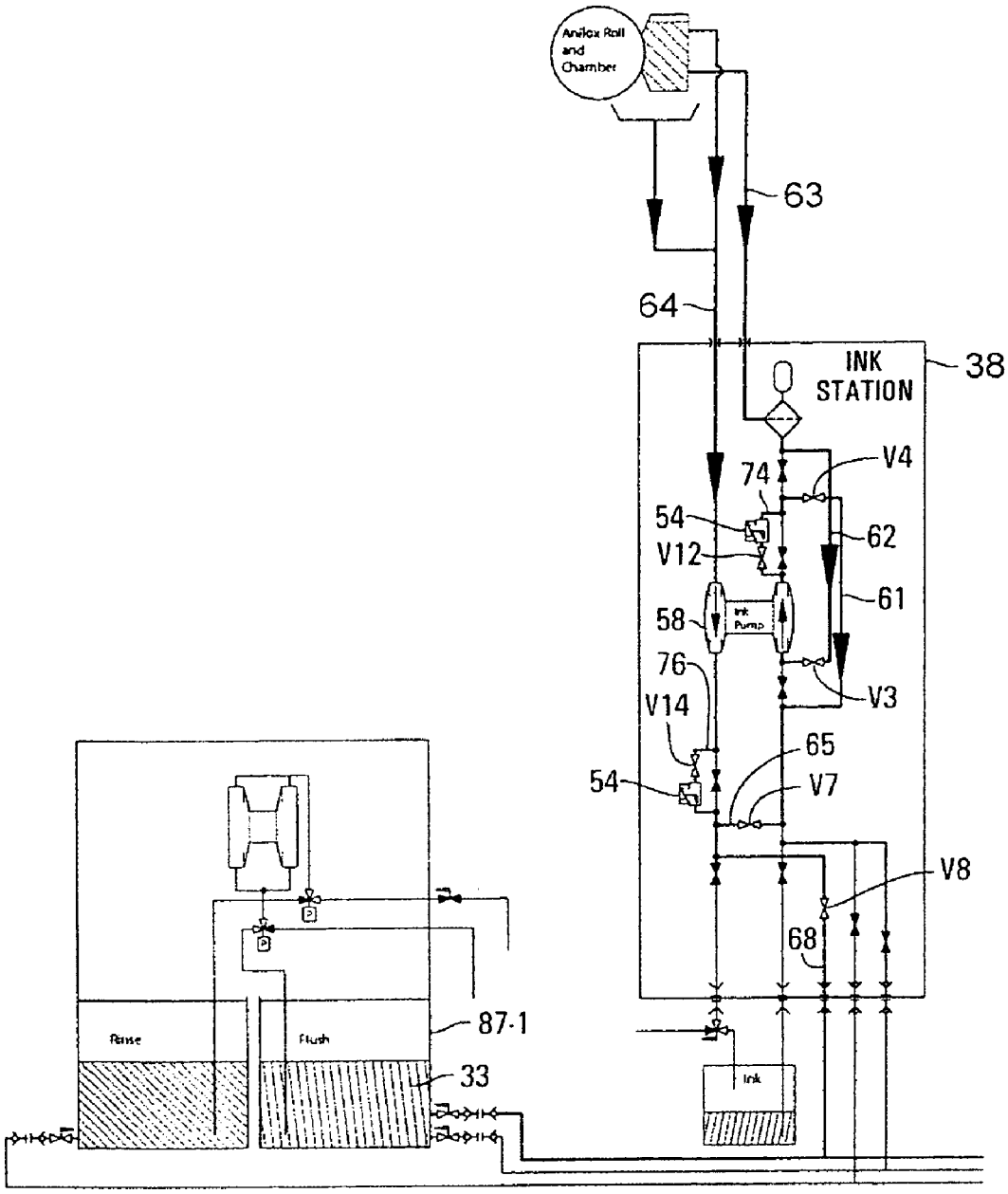
FIG. 15 is a schematic illustration of an exemplary Flush Return process of the flexographic ink/flush system of FIG. 4.

When the Flush process is complete the ink pump 58 stops and the valves automatically switch for the Flush Return process. Specifically, as shown in FIG. 15, the valves V8, V7, V3, V12, V4, and V14 are opened. The pump 58 is run in a "pull-back" mode to pull the used flush 33 out of the ink circuits and to return it, via lines 68, 65, 61, 62, 74, 63, 64, and 76 to the used flush tank 87-1 in order to be reused in future Flush/Rinse cycles. The duration of the flush return step is automatically determined by monitoring the flow sensors 54. When the flow back to the used flush tank 87-1 is complete, (i.e., judged to be a programmable number of seconds after the flow sensors 54 indicates a no-flow condition) the ink pump 58 is turned off and the inking station's 38 return valves are closed. This occurs for each deck that is undergoing the Flush/Rinse cycle. When the last deck shuts down, the ink pump 58 is stopped and the valves V1 through V16 may return to their de-energized positions.

Used Flush Discharge

In the remaining rinse steps, the clean rinse 31 will be taken from the clean rinse tank 87-1 to be circulated in the inking circuit and will be returned to the used flush tank 87-2 as will be described. The control station 42, however, may calculate whether the used flush tank 87-1 is available to accept the projected used clean rinse 31, based upon how many decks are undergoing the Flush/Rinse cycle and how much empty volume must be available in the used flush tank 87-1. If the available volume is sufficient to accept the used clean rinse 31, the control station 42 will skip the described Used Flush Discharge process. If, however, the available volume is insufficient for the remaining processes, the Flush/Rinse cycle will stop after the Flush Return process and alert the operator via the warning light in the light tower 90 and a message on the display 43 that a specific amount of the used flush 33 must be discharged before the process will be able to continue with the Rinse Priming process.

Figure 16:
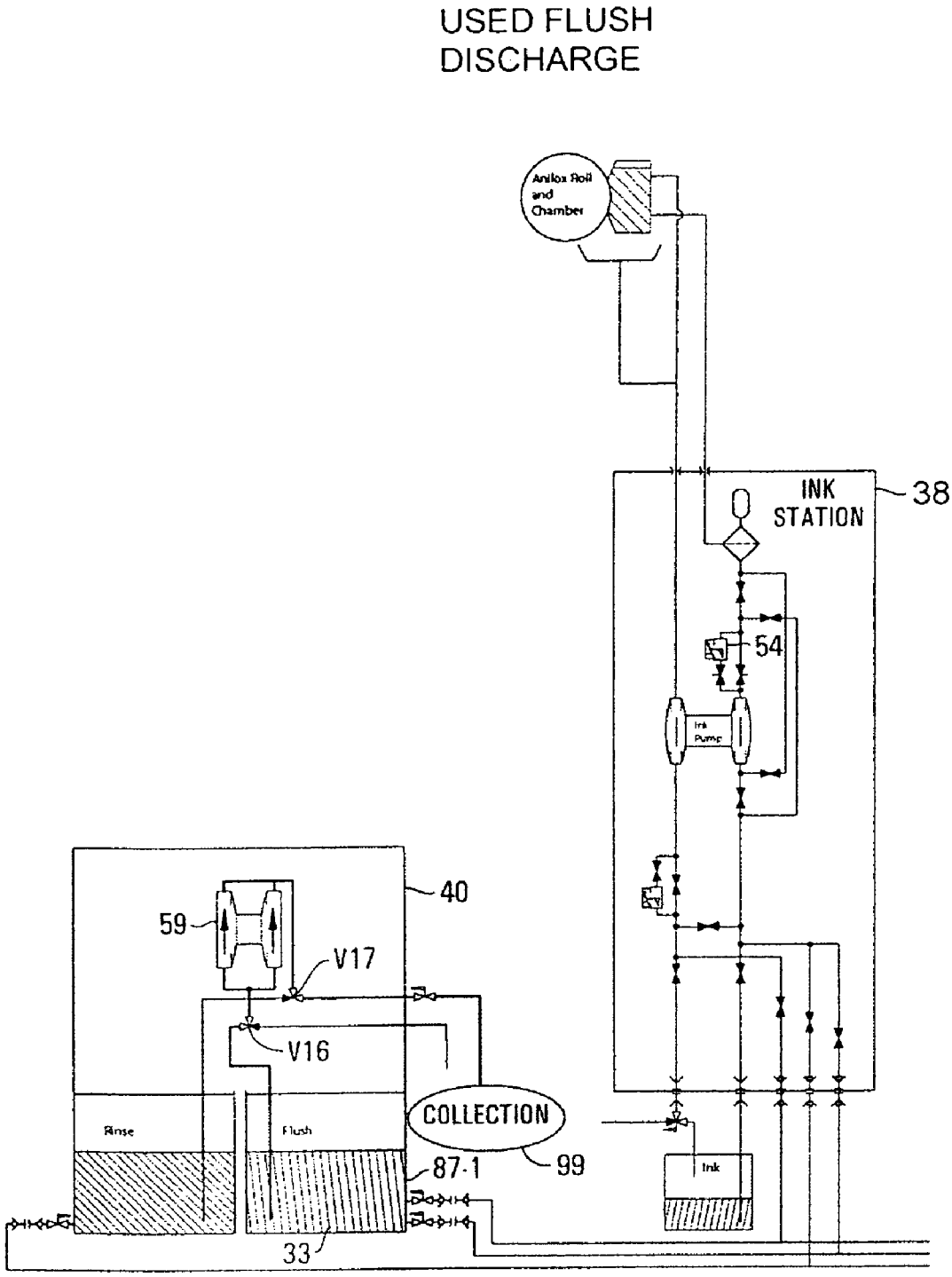
FIG. 16 is a schematic illustration of an exemplary Used Flush Discharge process of the flexographic ink/flush system of FIG. 4.
Figure 17:
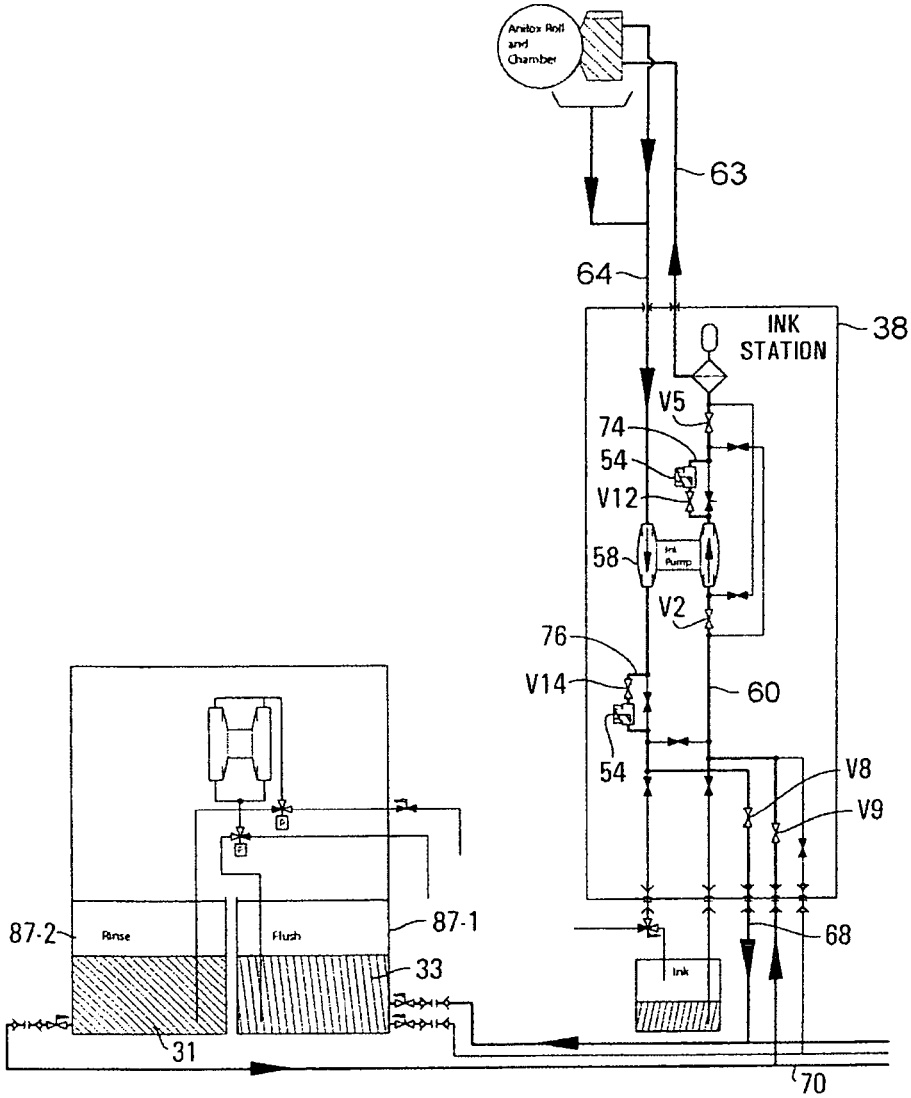
FIG. 17 is a schematic illustration of an exemplary Rinse Priming process of the flexographic ink/flush system of FIG. 4.

Turning to FIG. 16, once the operator gives the go-ahead to discharge the used flush 33, valves V16 and V17 are automatically configured and the flush pump 59 discharges the used flush 33 from the used flush tank 87-1 to a customer discharge or collection system 99. A minimum discharge will result in just enough used flush 33 being removed to allow the rinse steps to be completed, while a full discharge will result in the used flush tank 87-1 being completely emptied to the level limit defined by the operator. The decision of which discharge mode to select by the operator would typically be based upon the cleanliness condition of the used flush 33.

In one embodiment, if the operator is unable or unavailable to begin the Used Flush Discharge process prior to the Flush Return process described above, then the control station 42 will not initiate the Flush Return process in order to prevent the anilox roll 32 from drying out while at the same time continuing to rotate against the doctor blades 81, 83.

Rinse Priming

With sufficient volume available to accept the impending return of the used clean rinse 31, the rinse portion of the Flush/Rinse cycle can proceed with the Rinse Priming process. In this process, illustrated in FIG. 17, the valves V9, V2, V12, V5, V14, V8 are automatically switched to allow clean rinse 31 to be pumped by the ink pump 58 from the clean flush tank 87-2 into the fluid circuit via lines 70, 60, 74, 63, 64, 76, 68. Some fluid circuits may fill quicker than others due to a difference in filter cleanliness or due to other differences in the individual circuits such as pressure drops. Therefore, as the circuit becomes filled, as indicated by the sensors 54, the valve V8 on the return line 68 is closed and the recirculation valve V7 is opened. In this way, the circuit is assured to be filled and the amount of clean rinse 31 used is minimized. When the circuit(s) selected for Flush/Rinse are filled, the ink pump 58 continues to run, while the valves V8 and V9 are closed, isolating the circuit from the rest of the system 28.

Rinse Recirculation

Figure 18:
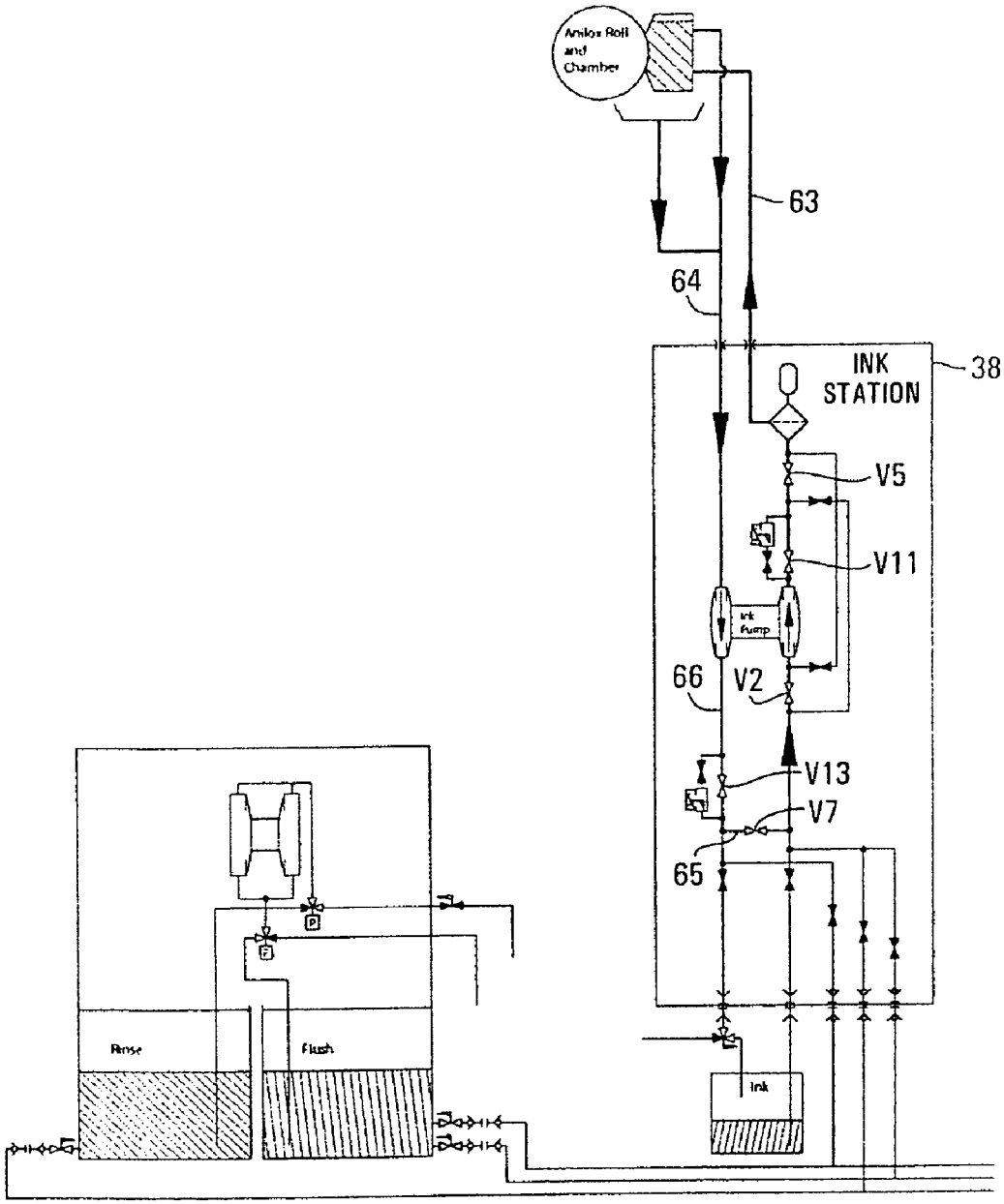
FIG. 18 is a schematic illustration of an exemplary Rinse process of the flexographic ink/flush system of FIG. 4.

The Rinse Recirculation process, illustrated in FIG. 18 is a timed step pre-programmed in the Flush/Rinse Recipe setup. With the circuit is full of clean rinse 31, the ink pump 58 is used to continuously circulate the clean rinse 31 through the ink circuit for the prescribed duration, dictated by the operator selected Flush/Rinse recipe. In the illustrated example, the valves V9, V2, V11, V5, V13, V8 are opened to create the recirculation circuit. In this way the process can get the maximum benefit from the clean rinse 31. When the Rinse time has expired, the ink pump 58 may continue to recirculate the clean rinse 31 and the operator may be notified that the Rinse recirculation time has expired and that the circuit is now in the Rinse Hold process.

Rinse Hold

Figure 19:
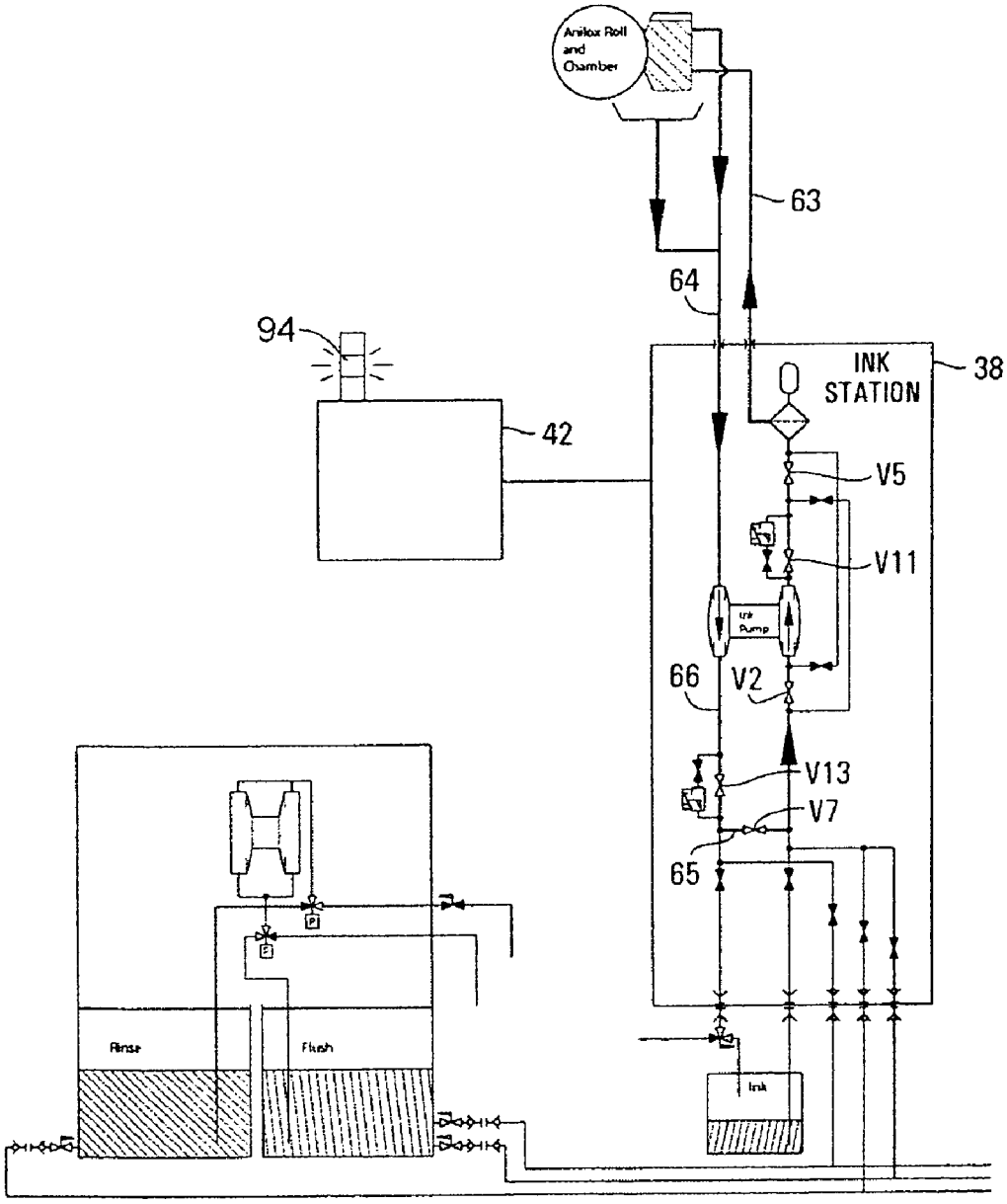
FIG. 19 is a schematic illustration of an exemplary Rinse Hold process of the flexographic ink/flush system of FIG. 4.

The Rinse Hold process, illustrated in FIG. 19 is similar to the Rinse Recirculation process except that the amber light 94 of the light tower 90 may flash and a message may appear on the display 43 indicating that the circuit is in Rinse Hold, and that the Ink/Flush system 28 is waiting for operator intervention to release the system to the Rinse Return process. The Rinse Hold process is utilized to ensure that the operator is prepared to complete the Flush/Rinse cycle and to prevent the anilox roll 32 from drying out while continuing to rotate against the doctor blade 81, 83.

Rinse Return

Figure 20:
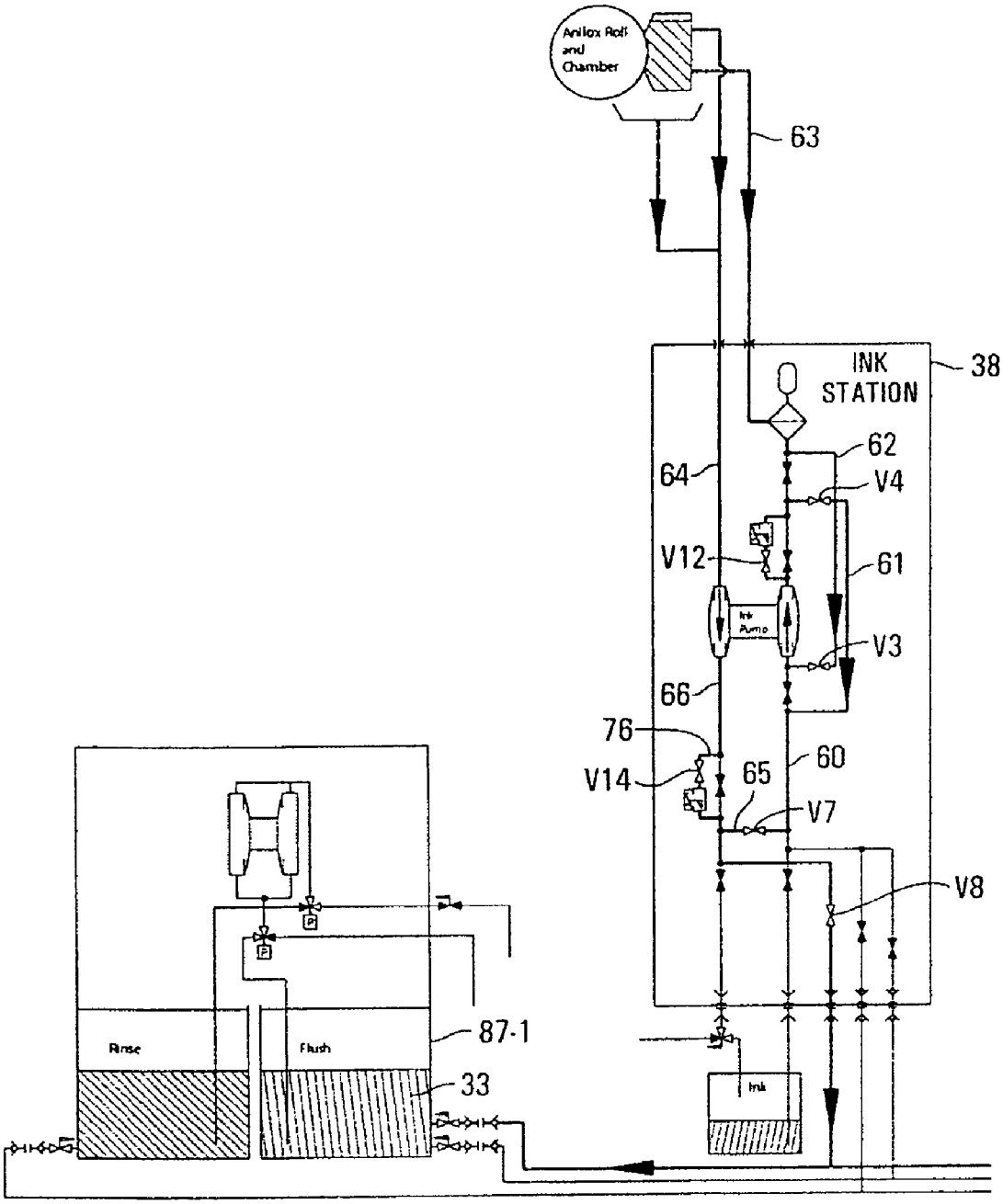
FIG. 20 is a schematic illustration of an exemplary Rinse Return process of the flexographic ink/flush system of FIG. 4.

The Rinse Return process, illustrated in FIG. 20 is similar to the Flush Return process (FIG. 15) except that used clean rinse 31 is being returned to the used flush tank 87-1 instead of the used flush 33. Specifically, when the Rinse Hold process has been released by the operator, the ink pump 58 may stop and the valves the valves V8, V7, V3, V12, V4, and V14 may be switched for the Rinse Return process. The pump 58 is run in a pull-back mode to pull the used clean rinse 31 out of the ink circuits and to return it, via lines 68, 65, 61, 62, 74, 63, 64, and 76 to the used flush tank 87-1 in order to be reused in future Flush/Rinse cycles. Again, the duration of the rinse return step is automatically determined by monitoring the sensors 54 located in the circuit. When the flow back to the used flush tank 87-1 is complete, (i.e., judged to be a programmable number of seconds after the flow sensors 54 indicates a no-flow condition) the ink pump 58 is turned off and the valves V1 through V16 are returned to the Off state described above. This occurs for each deck that is undergoing the Flush/Rinse cycle. When the last deck shuts down the Flush/Rinse cycle is complete.

The inking circuits are now ready for inspection. If the operator is not satisfied that the cycle durations resulted in sufficiently clean circuits he or she can ask the system to redo all or portions of the Flush/Rinse cycle as needed. Otherwise, the press can return to inking.

Clean Flush Fill

As indicated above, levels of both the clean rinse tank 87-2 and the used flush tank 87-1 are continually monitored during the Flush/Rinse cycle. When the level transmitter 88 detects that the level of clean rinse 31 is below a programmable threshold, the control station 42 will automatically start the Clean Flush Fill process.

Figure 21:
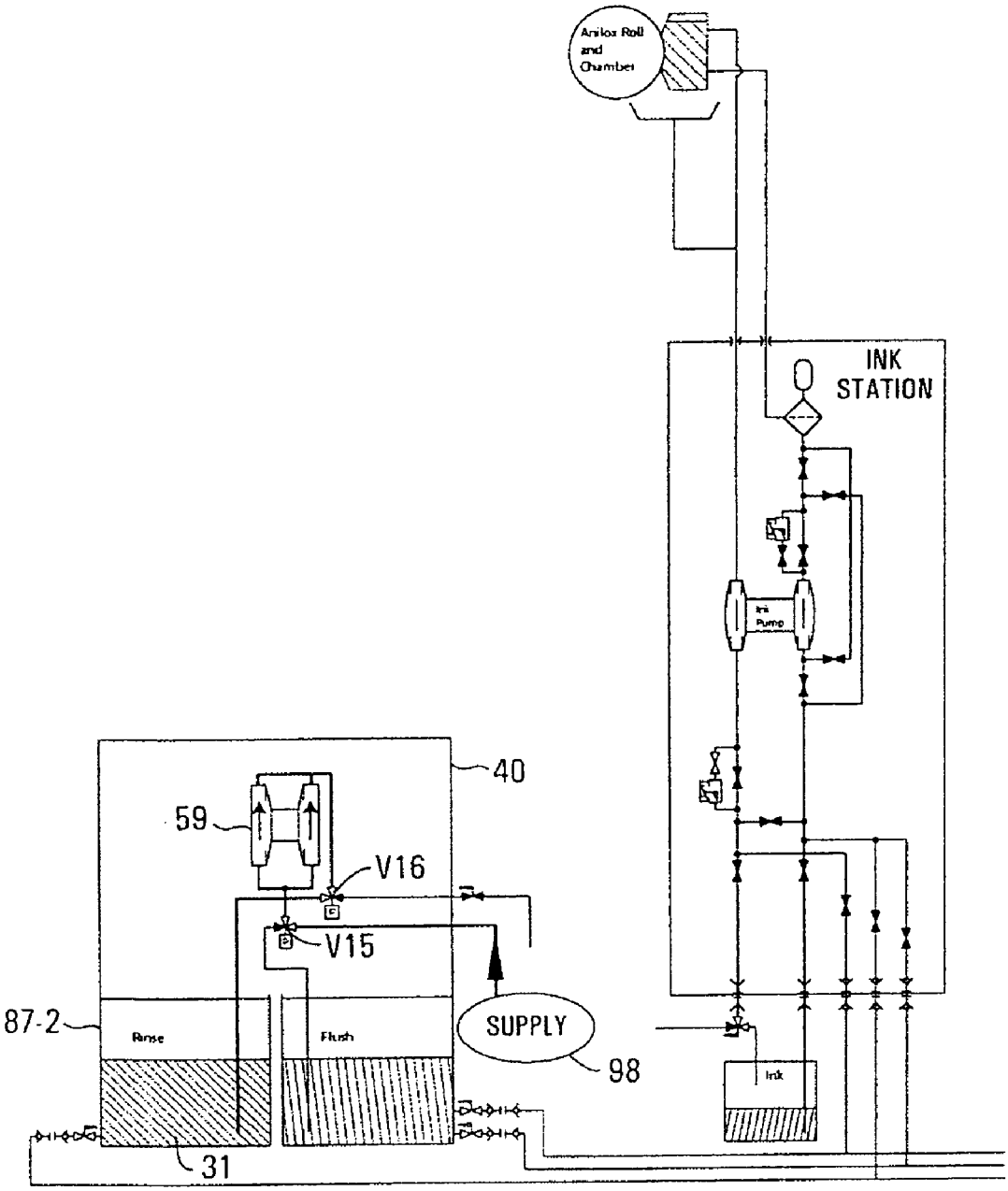
FIG. 21 is a schematic illustration of an exemplary Clean Flush Fill process of the flexographic ink/flush system of FIG. 4.

As shown in FIG. 21, once the control station initiates the Clean Flush Fill process, valves V16 and V17 are automatically configured and the flush pump 59 recharges the clean rinse 31 from a customer supply 98 to the clean rinse tank 87-2. A minimum recharge will result in just enough clean rinse 31 being added to allow the Flush/Rinse cycle to be completed, while a full recharge will result in the clean rinse tank 87-2 being completely filled to the level limit defined by the operator.

Operation Display

When the Control Station is powered up, the first screen displayed on the display 43 is the Main Index of the control station interface. From it, an operator can jump to any of the other Supervisor, Maintenance, Instructional or Operator screens. After the index, there are five major types of screens including Supervisor, Operator, Maintenance, Instructional and Alarm.

In the Flush/Rinse cycle, several decisions were left to the operator. In reality, the control station is programmed for three levels of operation; a supervisor, system maintenance and an operator. The supervisor screens are for inputting system parameters and for establishing recipes. Access is limited to the operator in order to improve control of the process. These screens may be password protected. Only persons with the password are allowed to view or modify the parameters contained on these screens. The operator screens are for the person(s) selecting the recipes for inking and/or for the Flush/Rinse cycle. Alarm screens will appear as needed to alert the operator during operation of the system.

The commands on the HML screen may be actuated by touching the screen (if the display 43 is touch sensitive), on the desired function cell, in order to activate or de-activate the desired function. Along with operating "buttons", drop-down fields, and entry fields, most screens also have transfer buttons to allow the operator to quickly transfer to related screens of interest.

When a supervisor or maintenance screen is selected, a password entry screen may appear. Once the required password is successfully entered, the control station will automatically move to the supervisor or maintenance screen that was initially requested. From there, the supervisor or maintenance personnel may transfer from one password protected screen to the next password protected screen without having to re-enter the password. However, once an individual exits from either the supervisor or the maintenance regions into the operator's screen, the password entry is cleared from the PLC and password re-entry is once again needed to access the supervisor or maintenance screens.

Several screens are dedicated to inputting system parameters at system installation and startup. It is used to communicate the unique system parameters to the controller. For example, the average volume of fluid in the headers between decks (as determined by the unique physical layout of each system's installation), the average volume of the ink chamber, supply and return lines. These values normally only need to be input once at startup. However, if the size of the tanks used for solvent are changed, the distances between stations 38, 40, 42 are significantly changed, or the tolerance values are not working well, the supervisor may need to enter different values.

The level transmitters 88 typically send an intrinsically safe 4 to 20 mA signals to the controller 41, indicating the actual real time solution level in the respective clean or used solution tank 87-1, 87-2. The control station 42 may then use the system parameter data (tank diameters and heights) to convert this 4–20 mA signal to a volume of solution contained within each tank 87-1, 87-2. The algorithms for this conversion are contained within the logic of the controller 41 program.

The "Ink Recipe Setup" screen can be used to enter up to ten different recipes for inking, along with the ink priming parameters. These recipes will become the choices that can be selected by the operator when running the system 28 in the Inking cycle. At least one ink recipe must typically be entered in order to pump ink through the fluid circuit. The recipes may be named to reflect that facilities' conventions.

The parameters contained within each individual ink recipe can include the ink supply speed (in gallons per minute (gpm)), for manual pump speed control. For the press speed following mode (automatic speed control of the pump) the minimum desired pump speed (gpm) when the press is not running and the maximum desired pump speed (gpm) for when the press is operating at it's maximum speed. The ink return speed (gpm) applies to both automatic and manual pump speed controls.

In one example, as the press 20 ramps up or increases its web speed, the ink is pumped faster to accommodate the press starting. The "Idle" entry may establish the pump's 58 idle speed and may be, for example, run at this speed for all press signals up to 15% of speed. The "Max" entry may be used to designate the pump's 58 maximum speed and may be used, for example, for all press speeds of 80% or higher. In between the 15% and 80% signals from the press the pump 58 typically ramps linearly from the idle to the max speed. It will be understood that the recipe may not dependent upon press speed Another pump speed for the supply of ink may be programmed for when the pump 58 is to supply ink at a constant flowrate. For example, a zero for the pump speed in this column indicates that the pump 58 is to be following the press 20. Finally, a speed for the return of ink may be programmed which is used when pulling the ink 30 back to the ink tank 85.

The "Flush/Rinse Recipe Selection" screen can be used to input a plurality of different flush recipes. Like the ink recipes, each is to be assigned a name.

As described above, many of the steps in the Flush/Rinse cycle are begun and ended automatically. The two exceptions are typically the duration of the Flush process and the duration of the rinse recirculation step which are entries in the Flush/Rinse recipe and are input in seconds. The other input is the speed for flush discharge, entered in gpm. In all likelihood, this speed will be a function of the type of collection used and will be input to be the same value for all Flush/Rinse recipes.

The operator may have two screens to contend with during normal operation, the screens being displayed on display 43. The first (and primary) screen is the "IFR Control Screen". From this screen the operator can perform any of the following operations. Select recipe(s) for inking. A recipe can be selected from those input for each deck independently. The operator can start inking, pause inking, or end inking. "Start" inking results in ink 30 being supplied from the ink tank 85 to the chamber 34 and also results in excess ink 30 being pumped back to the tank 85. "Pause" inking will result in the ink pump 58 being stopped but all associated valves will stay in the position assigned for inking. "End Ink" will result in valve reversal and in the ink 30 being pulled from the chamber 34 and the associated inking circuit back into the ink tank 85. Several of the operation buttons will change from one mode to the next to indicate what will happen if that button is pressed again. For example, the pause button may indicate, "Pause Pump". If it is pressed the ink pump will stop and the button will be changed to indicate, "Start Pump". Pressing the button again will result in the pumps being re-started and the button reverting to the function of a Pause button.

Also from this screen the Flush/Rinse cycle can be initiated. The operator can select which decks to flush, which recipe to use, and can begin the Flush/Rinse cycle processes. Once the cycle is started the controller 41 will automatically display the current status of each ink station in a banner above each ink stations' 38 area. The Flush/Rinse cycle may end on its own upon completion.

Only one recipe at a time for each or several decks may be selected for the Flush/Rinse process. It will be applied to all deck(s) selected for the Flush/Rinse process. It will be appreciated, however, that it may be possible to be inking on some decks while flushing other decks.

The IFR Control Screen may show all decks simultaneously and may show what mode of inking each deck is undergoing (Off, Circulating, Pump Stopped, Flushing, Returning Ink, or Error) and the speed of the ink pump in gpm. It also may show the press speed and the levels in the solvent tanks 87-1, 87-2, which decks are included in the Flush/Rinse cycle, what stage the cycle is in and; for timed processes, how much time is remaining. Like inking, the Flush/Rinse cycle can be paused. This may be done from the IFR Control screen. When paused, all valves will remain in their current state but the pumps will be paused until released by the operator. If the Flush/Rinse cycle needs to be terminated and reset for any reason, the cycle may be first paused and then a Reset button appears that if the operator activates the Reset button, the Flush/Rinse cycle may then move ahead to the Rinse Return process, and perform that step until completion, at which time all timers and buttons may be reset to their original state.

As described above, alarm screens and lights 92, 94, 96 may provide a notice of system conditions considered worthy of warning or alarm. Many of them are associated with the level in one or another of the solvent tanks 87-1, 87-2. Others may be programmed to alert of conditions of the system that are out of the ordinary bounds. Alarm and warning notices will appear automatically on the control station 42 display 43 and may be accompanied by a light on the tower 90. In the case of an alarm 96, the condition may also be accompanied by a horn to call immediate attention to its existence in case the operator is away from the control station. A notice may be given on a screen to detail what the condition is that is considered to be a problem. As will be understood, a number of alarm messages may be programmed.

There is a second operator accessible screen, that is the Flush Maintenance Screen. From this screen the operator can perform the two basic Flush Station 40 maintenance procedures that may be required as a part of normal operations. The two procedures are the Clean Flush Fill process and the Used Flush Discharge process described above. The Clean Flush Fill process is initiated from the Flush Maintenance Screen of the HMI by entering the amount of clean flush 31 needed to add to the clean flush tank 87-2, and then activating the process from the HMI screen. Once the process is activated, the controller 41 awaits for a second confirming signal, this second signal may originate from one of the Flush Station 40 buttons 104, 106, 108, 110. This second confirming signal requires the operator to walk to the Flush Station 40 and once the operator is ready to begin the Clean Fill process, the operator presses the green Start button. This second signal causes the controller 41 to change the Flush Station 40 valves to their activated state and then starts the Flush Pump 59. The Flush Pump 59 then begins pumping clean flush 31 into the clean flush tank 87-2 until one of two conditions have been met. The first condition being that the requested (as by the operator) amount of clean flush 31 has been transferred into the clean flush tank 87-2 or the second condition (and overriding condition) is that the overall level of clean flush 31 in the clean flush tank 87-2 is below the Maximum Safe Clean Flush Level (MSCFL), as entered in the controller 41. If the Clean Flush Solution level reaches the MSCFL, then the flush pump 59 will stop, and the flush station 40 valves V15, V16 will revert to their null state and the controller 41 may alert the operator that the clean flush tank's 87-2 level has reached it's maximum level and the process has been halted by the controller 41. The controller 41 may then reset the process.

The second routine maintenance procedure is the Used Flush Discharge process. This process is intended to reduce the level of used flush 33 in the used flush tank 87-1, by pumping out a desired volume of used flush 33. The Used Flush Discharge procedure is where the operator initiates the process from a Flush Maintenance Screen of the HMI by entering the amount of used flush 33 needed to discharge from the used flush tank 87-1, and then activating the process from the display 43. Once the process is activated, the controller 41 awaits for a second confirming signal, this second signal originates from one of the flush station 40 buttons 104, 106, 108, 110. This second confirming signal requires the operator to walk to the flush station 40 and once the operator is ready to begin the Used Flush Discharge process, the operator may press a start button. This second signal causes the controller 41 to start the flush pump 59. The flush pump 59 may then begin pumping used flush 33 from the used flush tank 87-1 until one of two conditions have been met. The first condition being that the amount requested (as by the operator) of used flush 33 has been transferred from the used flush tank 87-1 or the second condition (and overriding condition) is that the overall level of used flush 33 in the used flush tank 87-1 is above the Minimum Safe Used Flush Level (MSUFL), as entered in the controller 41. If the used flush 33 level reaches the MSUFL the flush pump 59 will stop and the controller 41, may alert the operator that the Used Flush 33 in the used flush tank 87-1 has reached it's minimum level and the process has been halted by the controller 41. The controller 41 will then reset the process.

If either process is halted or paused by the operator, from either the control station 42 or from the flush station 40, and the process is not resumed within a certain time (as defined in the system parameters) then the controller 41 will reset either process to its null state.

Also contained within this screen are two other areas of informational interest to the operator of the IFR system. The first area is the pump cycle counters. This area indicates how many cycles (strokes) each pump 58, 59 has accumulated since it was last rebuilt or refurbished. There is a separate count for each individual ink station 38 contained within the system 28 as well as a counter for the flush station pump 59. These counters are simply an indicator to be used as a tool by the operator in order to help schedule preventative maintenance and to minimize system downtime.

The second area of informational interest to the operator is the air filter hours since replacement indicators. These are individual hour meters that keep track of the accumulated time for each of the disposable air filters located within the control station 42 and within each individual ink station 38. These timers are simply an indicator to be used as a tool by the operator in order to help schedule preventative maintenance and to minimize system downtime and problems as result of a contaminated air supply.

Contained within the Maintenance display screens is the following information. First are the individual cycle counters for each of the pumps 58, 59 that are contained within the system 28. This includes counters for each of the ink station pumps 58 as well as the flush station pump 59. These cycle counters are based on the output pulses from the Pump Output Signal of the controller 41 that are sent to each pump 58, 59. The actual cycle counts for each pump 58, 59 are compared to a theoretical maximum cycle life for the pump 58, 59. Once the cycle count exceeds an initial threshold count, a preventative maintenance (PM) alert may be issued via the display 43. When a second cycle threshold count has been exceeded, an alarm may be issued via the display 43. Once the alarm has been performed or a pump 58, 59 has been replaced then the cycle counter can be reset to zero, and the warning and alarms will be reset. Also on this display 43 is an overall, non re-settable cycle counter. This counter is again based on the output pulses from the output module of the PLC, and is simply a means of tracking over all time on a particular set of operating hardware. This counter is not user re-settable.

The second area of informational interest to the maintenance personnel is the air filter hours since replacement indicators. These are individual hour meters that keep track of the accumulated time for each of the disposable air filters located within the control station 42 and within each individual ink station 38. These timers are simply an indicator to be used as a tool by the maintenance personnel in order to help schedule preventative maintenance and to minimize system downtime and problems as result of a contaminated air supply. Once a filter has been replaced, then the time can be reset by the maintenance personnel.

The on-line Instructions contain two sections. The first section is the primary system operating manual. This section contains all of the basic operating instructions of the IFR system. These instructions can include the following: 1) Basic operating instructions, 2) System alerts, warnings, alarms and suggested courses of action for each alert, warning and/or alarm, 3) Preventative Maintenance interval recommendations, procedures and practices, and 4) Recommended initial system startup parameters.

The second section is a troubleshooting guide for the system 28. The section contains step by step instructions to assist the operator or maintenance personnel in finding and solving a problem with the system 28.

In view of the foregoing, it will be appreciated that certain exemplary aspects and details of the various examples and/or embodiments need not be mutually exclusive relative to other examples and embodiments. Thus, those of ordinary skill in the art will appreciated that certain features of our embodiment may be interchanged with certain features of another embodiment without departing from the spirit and scope of the appended claims.

Numerous additional modifications and alternative embodiments of the invention will be apparent to those of ordinary skill in the art in view of the foregoing description. This description is to be construed as illustrative only, and is for the purpose of teaching those or ordinary skill in the art the best mode of carrying out the invention. The details of the structure and method may be varied substantially without departing from the spirit of the invention, and the exclusive use of all modifications which come within the scope of the appended claims is reserved.

I claim:

1. An inking and cleaning system for use on a printing press, the system comprising:

a fluid circuit having a first operating configuration wherein the fluid circuit is adapted to supply an ink to the printing press, a second operating configuration wherein the fluid circuit is adapted to supply a cleaning solution to the printing press, a first pump operatively coupled to a source of the ink to circulate the ink through the fluid circuit, a second pump operatively coupled to a source of the cleaning solution to circulate the cleaning solution through the fluid circuit, and one or more valves arranged to switch the fluid circuit between the first operating configuration and the second operating configuration;

the fluid circuit arranged to supply a selected one of a clean rinse or a used flush through the fluid circuit when the fluid circuit is in the second operating configuration;

the fluid circuit further arranged to draw an amount of clean rinse through the fluid circuit and return a resulting volume of used clean rinse into a used flush tank if a desired amount of the used flush is deficient; and a controller operatively coupled to the fluid circuit and adapted to cause the fluid circuit to switch between the first operating configuration and the second operating configuration, the controller further arranged to supply first the used flush and second the clean rinse through the fluid circuit and calculate whether a volume of the used flush tank is available to accept the resulting volume of used clean rinse when the fluid circuit is in the second operating configuration.

2. The system of claim 1, wherein the first operating configuration is adapted to supply the ink from an ink source and return any unused ink to the ink source; and wherein the second operating configuration is adapted to return the used flush solution to the used flush tank after use.

3. The system of claim 1, wherein the one or more valves are arranged in a first valve configuration placing the fluid circuit in flow communication with an ink source; and wherein the one or more valves are arranged in a second valve configuration placing the fluid circuit in flow communication with a cleaning solution tank and the used flush tank.

4. The system of claim 1, further comprising a clean solution tank;

wherein the fluid circuit is adapted to return the solution from at least one of the clean solution tank and the used flush tank to the used flush tank.

5. The system of claim 4, wherein at least one of the clean solution tank and the used flush tank further comprises a level transmitter adapted to determine a volume of solution in the clean solution tank or the used flush tank.

6. The system of claim 1, further comprising a solution fluid circuit, a solution pump, a solution source, a solution discharge, and at least one solution valve, the solution valve being arranged to place the solution fluid circuit in flow communication with at least one of the clean solution tank and the used flush tank.

7. The system of claim 1, wherein the fluid circuit further comprises a surge suppressing filter disposed between the first pump and the printing press.

8. The system of claim 1, wherein the fluid circuit further comprises at least one flow sensor.

9. The system of claim 1, wherein the fluid circuit is adapted to supply a used flush to the printing press for flushing, and wherein the fluid circuit is further adapted to supply a clean rinse to the printing press for rinsing.

10. The system of claim 1, wherein the system further comprises a display operatively coupled to the controller, the display being adapted to display information to a user.

11. The system of claim 1, wherein the system further comprises a light tower coupled to the controller, the light tower being adapted to display information to a user.

12. The system of claim 1, wherein the fluid circuit is adapted to supply the ink from an ink source to the printing press for use, return any unused ink to the ink source, supply the clean rinse from a clean rinse tank to the printing press for flushing the printing press, and return the clean rinse to a used flush tank after use.

13. The system of claim 1, wherein the controller is further adapted to displace a volume of used flush from the used flush tank when the resulting volume of used clean rinse is greater than the volume of the used flush tank.

14. The system of claim 1, further comprising a plurality of headers, the headers configured to supply at least one of the used flush or the clean rinse to the fluid circuit, and to return of at least one of the used flush or the clean rinse to the used flush tank.

15. The system of claim 1, further comprising a plurality of sensors, at least one of the plurality of sensors configured to:

indicate a used flush level of the used flush tank;

indicate an ink level of an ink tank;

indicate a clean rinse level of a clean rinse tank; or indicate at least one of a flow or a no-flow condition in the fluid circuit.

16. An inking and flushing system for use on a chamber doctor blade system, the system comprising:

a fluid circuit having a first operating configuration wherein the fluid circuit is adapted to supply an ink to the printing press via an ink supply pump and a second operating configuration wherein the fluid circuit is adapted to supply a solution to the printing press via a flush pump, the fluid circuit arranged to circulate at least one of the ink or the solution through the fluid circuit and including one or more valves to switch the fluid circuit between the first operating configuration and the second operating configuration;

an ink station operatively coupled to the ink supply pump and adapted to provide ink to the fluid circuit;

a flush station operatively coupled to the flush pump and adapted provide the solution to the fluid circuit, the solution including a selected one of a used flush and a clean rinse; and a controller operatively coupled to the fluid circuit and adapted to cause the fluid circuit to switch between the first operating configuration and the second operating configuration, select a desired one of the used flush or the clean rinse when in the second operating configuration, provide first the used flush and then the clean rinse when in the second operating configuration, if a desired amount of the used flush is deficient, draw an amount of clean rinse through the fluid circuit, the amount being sufficient to clean the fluid circuit, calculate an unfilled volume of a used flush tank, displace a volume of used flush from the used flush tank when the unfilled volume of the used flush tank is less than the amount of clean rinse drawn through the fluid circuit, and deposit the amount of clean rinse drawn through the fluid circuit into the used flush tank;

wherein the ink supply pump and the flush pump are double diaphragm pumps arranged to supply and return substantially the same volume of fluid.

17. The system of claim 16, wherein the flush station further comprises a clean rinse tank, wherein the flush station is adapted to supply the solution from at least one of the clean rinse tank and the used flush tank to the fluid circuit for use in flushing the chamber doctor blade system, and return the solution to the used flush tank.

18. The system of claim 16, wherein the ink supply pump and the flush pump are double diaphragm air driven pumps.

19. The system of claim 16, wherein the flush station further comprises:

a solution fluid circuit adapted to supply solution to the flush station and remove solution from the flush station;

a solution pump;

a solution source; and a solution discharge tank.

20. The system of claim 16, wherein the ink station is adapted to supply the ink from the ink station to the fluid circuit for use in the chamber doctor blade system and wherein the ink station is further adapted to return any unused ink to the ink station.

21. A method of inking and flushing a printing press, the method comprising:

supplying an ink to an operating printing press through a fluid circuit, the fluid circuit comprising a plurality of fluid lines, a flush pump, an ink pump, and a plurality of valves;

removing ink from the fluid circuit;

supplying a first solution to the operating printing press through the fluid circuit, the first solution comprising first a used solution and then a clean rinse;

flushing the operating printing press and the fluid circuit with the first solution;

removing the first solution from the fluid circuit to a used solution tank;

supplying an amount of a second solution to the operating printing press through the fluid circuit, the second solution comprising a clean rinse;

flushing the operating printing press and the fluid circuit with the amount of the second solution;

calculating whether the amount of the second solution is greater than or less than an empty volume of the used solution tank;

removing the second solution from the fluid circuit to the used solution tank if the amount of the second solution is less than the empty volume of the used solution tank;

displacing an amount of the first solution from the used solution tank and removing the second solution from the fluid circuit to the used solution tank if the amount of the second solution is greater than the empty volume of the used solution tank.

22. The method of claim 21, further comprising:

determining at least one of an amount of time and a volume of clean rinse to effectively clean a selected portion of the fluid circuit;

circulating the volume of clean rinse through the selected portion of the fluid circuit for the determined amount of time, the selected portion of the fluid circuit including an ink circuit.

23. The method of claim 21, further comprising determining an inking recipe, the inking recipe including at least one of an ink supply speed, a minimum ink pump speed, a maximum ink pump speed, a constant ink pump speed, and an ink return speed;

wherein the ink supply speed corresponds to a fluid circuit manual configuration; and wherein at least one of the minimum ink supply speed and the maximum ink pump speed corresponds to a fluid circuit automatic configuration.

24. The method of claim 21, further comprising determining a flush recipe, the flush recipe including at least one of a duration of a flush process, a duration of a rinse recirculation, and a speed of a flush discharge; and determining the speed of the flush discharge according to a discharge collection method.

25. The method of claim 21, further comprising priming the fluid circuit with at least one of the ink, the first solution, and the second solution.

26. The method of claim 21, further comprising circulating the first solution within the fluid circuit for a period of time.

27. The method of claim 21, further comprising circulating the second solution within the fluid circuit for a period of time.

28. The method of claim 21, further comprising accepting operating parameters from an operator.

29. The method of claim 21, further comprising removing used solution from the used solution tank.

30. The method of claim 29, further comprising monitoring the volume of used solution in the used solution tank.

31. The method of claim 21, wherein the amount of used solution from the used solution tank is equal to the amount of the second solution.

* * * * *